US007198088B2

(12) United States Patent
McMenamin et al.

(10) Patent No.: US 7,198,088 B2
(45) Date of Patent: Apr. 3, 2007

(54) BLIND/CURTAIN MOUNTING BRACKET FOR CURTAIN RODS

(76) Inventors: Tim McMenamin, 222 Madison St., Linden, NJ (US) 07038; Joanne Downey, 942 Courthouse Rd., Apt. 1, Gulfport, MS (US) 39507

( * ) Notice: Subject to any disclaimer, the term of this patent is extended or adjusted under 35 U.S.C. 154(b) by 0 days.

(21) Appl. No.: 11/358,962

(22) Filed: Feb. 22, 2006

(65) Prior Publication Data

US 2006/0175025 A1 Aug. 10, 2006

Related U.S. Application Data

(63) Continuation of application No. 11/054,989, filed on Feb. 10, 2005, now abandoned.

(51) Int. Cl.
*A47H 1/10* (2006.01)

(52) U.S. Cl. ..... 160/89; 248/262; 248/263; 160/123

(58) Field of Classification Search ..... 160/38, 160/39, 123, 126, 19, 89; 248/262, 263, 248/255, 215

See application file for complete search history.

(56) References Cited

U.S. PATENT DOCUMENTS 2,506,160 A * 5/1950 Martin et al. ..... 248/255
2,706,100 A * 4/1955 Thomason ..... 248/255
2,848,184 A * 8/1958 Kennedy ..... 248/263
2,955,794 A * 10/1960 Robbins ..... 248/263
4,384,605 A * 5/1983 Schaeffer et al. ..... 160/38
4,684,095 A * 8/1987 Athey ..... 248/255
4,828,002 A * 5/1989 Ashby ..... 160/38
4,840,216 A * 6/1989 John ..... 160/178.1 V
5,520,235 A * 5/1996 Coleman ..... 160/89
5,765,620 A * 6/1998 Coleman ..... 160/89
6,601,809 B1 * 8/2003 Gebrara ..... 248/229.16
6,840,482 B2 * 1/2005 Downey et al. ..... 248/262

* cited by examiner

*Primary Examiner*—Blair M. Johnson
(74) *Attorney, Agent, or Firm*—Ezra Sutton, Esq.

(57) ABSTRACT

An improved mounting bracket for use in attaching curtain rods in conjunction with an upper beam of a standard blind bracket mounting device of a blind assembly. The mounting bracket is slidably mounted on the upper beam of the blind assembly and prevents the blind assembly from falling out of the blind bracket mounting device. The mounting brackets include first and second bracket housings having joint first and second seam sections for forming first and second holding wall clip members, respectively. The first holding wall member includes a pair of spaced-apart outer first and inner second holding prong members being integrally connected to an exterior first wall surface. The third holding wall member includes a pair of spaced-apart outer third and inner fourth holding prong members being integrally connected to an exterior third wall surface. Each of said first and second holding wall clip members of the first and second bracket housings are detachably connected to a blind assembly; and each of the upper first, second, third and fourth prong tab members of the first, second, third, and fourth prong members, respectively, for receiving one or more curtain rods thereon.

7 Claims, 20 Drawing Sheets

BLIND/CURTAIN MOUNTING BRACKET FOR CURTAIN RODS

RELATED APPLICATION

This application is a continuation of U.S. patent application Ser. No. 11/054,989 filed Feb. 10, 2005 now abandoned.

FIELD OF THE INVENTION

The invention relates to an improved mounting bracket for use in attaching curtain rods in conjunction with an upper beam of a standard blind bracket mounting device of a blind assembly. More particularly, the mounting bracket is slidably mounted on the upper beam of the blind assembly and prevents the blind assembly from falling out of the blind bracket mounting device.

BACKGROUND OF THE INVENTION

Mounting brackets of various designs have been used to support shades, blinds, curtains, valances, cornices and the like. These brackets are mounted or fastened to a wall, or to a window frame in a number of various positions depending upon the structure of the mounting bracket and/or hanging element (i.e. curtain). Conventional designs for these mounting brackets include channel-type, metal headrails; box-like metal structures having a plurality of slide plates therein; U-shaped metal structures having a screw clamp; an L-shaped metal flange having a snap holder; an inverted L-shaped metal stamping having horizontal and vertical wings; and an inverted L-shaped metal flange having a slide plate holder.

However, these prior art mounting brackets have various drawbacks and have not been completely satisfactory. For example, they do not securely hold the curtain or blinds to prevent them from being pulled out of the mounting bracket during use.

It would be highly desirable to provide improved curtain mounting brackets which are integrated with the blind apparatus, and easily mounted for simple installation. The curtain mounting brackets when installed should hold the curtain rod(s) firmly locked in place to avoid the curtain rod(s) being snapped out of the blind apparatus during the use of the blind or curtain members.

DESCRIPTION OF THE PRIOR ART

Mounting brackets for blinds and curtains or valances of various designs, configurations structures and materials of construction have been generally disclosed in the prior art. For example, U.S. Pat. No. 4,305,562 to BELLINGER discloses an outer corner edge curtain rod holder for supporting a curtain rod on the corner of a window frame structure. The holder includes a rod support section and a securing section attached to the outer edge of the corner. This prior art patent does not disclose or teach the design, structure and configuration of the improved blind/curtain mounting bracket of the present invention.

U.S. Pat. Nos. 5,392,833 and 5,439,042 to OHANESIAN disclose a vertical blind assembly with curtain attachments. Mounting brackets are provided which connect a rear portion of the curtain to individual slat carriers slidably mounted within the housing of the vertical blind assembly. In this manner, lateral movement of the carriers, which causes opening and closing of the vertical blinds, likewise causes an opening and closing of the curtain. The bracket extends a sufficient distance from the housing such that the curtain does not hinder pivoting of the vertical blinds. These prior art patents do not disclose or teach the design, structure and configuration of the improved blind/curtain mounting bracket of the present invention.

U.S. Pat. No. 5,529,273 to BENTHIN discloses mounting bracket devices for window and door coverings in which these devices are used for mounting curtain rods and blind tracks. The mounting bracket and base is secured to an arm by a fastener. A cam post has a head that is connected to the arm by a shaft. A spring clip has an aperture that is contoured in correspondence with the head and is retained between the head and arm at selected angular positions about the cam post. This prior art patent does not disclose or teach the design, structure and configuration of the improved blind/curtain mounting bracket of the present invention.

U.S. Pat. No. 5,667,178 to YANG discloses a bracket assembly for mounting a shade. The mounting bracket assembly is provided for supporting shades, blinds, curtains, cornices, and valances having a support rail, which includes an L-shaped mounting section having an integrally connected back member, interior side members and an extended top member, and the extended top member having a U-shaped channel formed therein for fitting into a U-shaped channel of the support rail. It also includes an L-shaped holding section having an integrally connected rear member, exterior side members, and a bottom support member for supporting the support rail in place. A threaded bolt is provided for connecting an interior lip member of the mounting section with an exterior lip member of the holding section to join the mounting section and the holding section to form the mounting bracket assembly. This prior art patent does not disclose or teach the design, structure and configuration of the improved blind/curtain mounting bracket of the present invention.

U.S. Pat. No. 5,975,184 to NEIN et al. discloses a decorative plate structure assembly for an upper beam of a vertical/horizontal blind. The decorative plate structure includes an upper beam, two sealing caps, two sealing covers, a left and a right decorative plates and multiple intermediate decorative plates. A boss outward projects from a center of the sealing cover. A dovetail block is disposed at an end of the boss. A back side of each of the left and right decorative plates is disposed with a transverse dovetail channel. The back side of each intermediate decorative plate is disposed with a fastener member. The dovetail channels of the left and right decorative plates are fitted with the dovetail blocks of the bosses of the sealing covers, permitting the left and right decorative plates to be replaceably slidably located on the upper beam, the fastener member of the intermediate decorative plate clipping a front side of the upper beam, permitting the intermediate decorative plate to be replaceably slidably located on the upper beam. The decorative plates are freely replaceably and movably located on the upper beam to beautify the same. This prior art patent does not disclose or teach the design, structure and configuration of the improved blind/curtain mounting bracket of the present invention.

U.S. Pat. No. 5,979,848 to KURTHY et al discloses a curtain and mini blind hanger. The window covering hanger includes a mounting bracket having a horizontally oriented top face and a vertically oriented rear face coupled to a rear edge of the top face and depending downwardly therefrom. A front face is coupled to a front edge of the top face and depends downwardly therefrom. The top face of the mounting bracket rests on a top ledge of a window frame and the rear face is situated between the window frame and an adjacent wall. A securement mechanism is mounted on the mounting bracket for securing to an end of a rod of a window covering. This prior art patent does not disclose or teach the design, structure and configuration of the improved blind/curtain mounting bracket of the present invention.

U.S. Pat. No. 6,216,889 to CHANG discloses a rod rack supporting structure including two support frames, a rod, and two locating members. The support frames are provided with a cross rod which is in turn provided with a plurality of retainers for retaining the rod. The retainers are provided in both plate surfaces of the opening thereof with a slide block. The locating members are provided in the inner side thereof with an arcuate slot and a slide slot corresponding to the slide blocks which are engaged with the two slide slots. This prior art patent does not disclose or teach the design, structure and configuration of the improved blind/curtain mounting bracket of the present invention.

None of the aforementioned prior art patents teach or disclose the features and structure of an improved blind/curtain mounting bracket for use with standard blind tracks, such that the mounting bracket is integrated with a standard blind apparatus in order to hold two standard curtain flat rods or a standard cylindrical curtain rod(s) in place.

Accordingly, it is an object of the present invention to provide an improved blind/curtain mounting bracket for use in attaching one or more curtain rods for hanging curtains and valances in conjunction with a blind bracket mounting device of a standard blind apparatus.

Another object of the present invention is to provide an improved blind/curtain mounting bracket that is an integrated component of the blind bracket mounting device and prevents the vertical or horizontal blind members from falling out.

Another object of the present invention is to an improved blind/curtain mounting bracket that does not utilize any screws, staples or nails, nor do damage to a standard window blind mounting assembly.

Another object of the present invention is to provide an improved blind/curtain mounting bracket that does not require any permanent setting on the blind frame assembly, and each curtain mounting bracket is slidably mounted within each blind bracket mounting device.

Another object of the present invention is to provide an improved blind/curtain mounting bracket that will leave no screw or nail marks, holes or any permanent scarring to the standard window blind mounting assembly.

Another object of the present invention is to provide an improved blind/curtain mounting bracket that can be installed in less than one minute without the use of any tools.

Another object of the present invention is to provide an improved blind/curtain mounting bracket that can hold in excess of five (5) pounds of weight.

Another object of the present invention is to provide an improved blind/curtain mounting bracket that is made of light-weight stamped metals or durable and rigid moldable plastics.

Another object of the present invention is to provide an improved blind/curtain mounting bracket that can be used with a pair of standard flat curtain rods or with one or more standard cylindrical curtain rod.

A further object of the present invention is to provide an improved blind/curtain mounting bracket that can be mass produced in an automated and economical manner and is readily affordable by the consumer.

BRIEF DESCRIPTION OF THE DRAWINGS

Further objects, features, and advantages of the present invention will become apparent upon the consideration of the following detailed description of the presently preferred embodiment when taken in conjunction with the accompanying drawings, wherein.

SUMMARY OF THE INVENTION

In accordance with the present invention, there is provided blind curtain mounting brackets for curtain rods for use with conventional blind bracket mounting devices of a blind assembly for attaching one or more curtain rods thereon in order to hold a curtain and/or valance thereto. The blind/curtain mounting brackets includes a first bracket housing having a first holding wall member and a second holding wall member being integrally attached with each other at a joint first seam section for forming a first holding wall clip member. The first holding wall member includes an exterior first wall surface and an interior first wall surface, and the second holding wall member includes an exterior second wall surface and an interior second wall surface. The exterior first wall surface of the first holding wall member includes a pair of spaced-apart outer first and inner second holding prong members being integrally connected to the exterior first wall surface. Each of the outer first and inner second holding prong members include prong holding first and second side walls with upper first and second prong tab members, respectively, thereon.

The blind/curtain mounting brackets further includes a second bracket housing having a third holding wall member and a fourth holding wall member being integrally attached with each other at a joint second seam section for forming a second holding wall clip member. The third holding wall member includes an exterior third wall surface and an interior third wall surface, and the fourth holding wall member includes an exterior fourth wall surface and an interior fourth wall surface. The exterior third wall surface of the third holding wall member includes a pair of spaced-apart outer third and inner fourth holding prong members being integrally connected to the exterior third wall surface. Each of said outer third and inner fourth holding prong members include prong holding third and fourth side walls with upper third and fourth prong tab members, respectively, thereon.

Further, each of the first and second holding wall clip members of the first and second bracket housings are detachably connected to a blind assembly; and each of the upper first, second, third and fourth prong tab members of the first, second, third, and fourth holding prong members, respectively, are used for receiving one or more curtain rods thereon.

DETAILED DESCRIPTION OF THE EMBODIMENTS OVERVIEW

Figure 1:
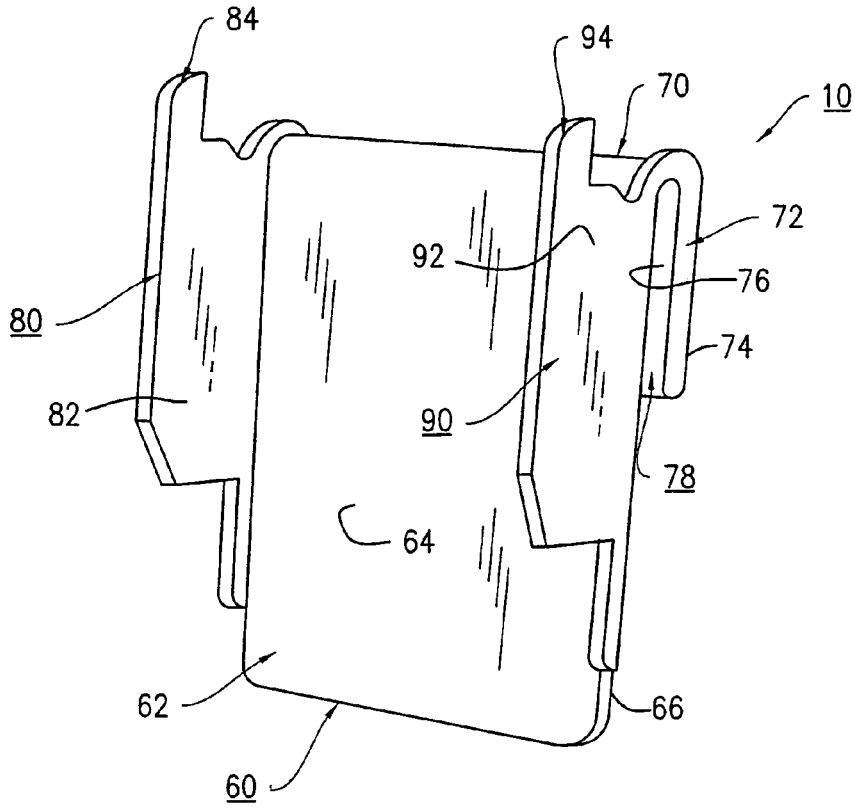
FIG. 1 is a front perspective view of the blind/curtain mounting bracket of the first embodiment of the present invention showing holding prong members attached to a front holding wall member and the front holding wall member and a rear holding wall member being integrally connected with each other for forming a holding wall clip member.

The blind/curtain mounting brackets 10, 100, 200, 300, 400, 500, 600, 700 and 800 of the first, second, third, fourth, fifth, sixth, seventh, eighth and ninth embodiments of the present invention are represented in detail by FIGS. 1 through 30 of the patent drawings. The blind/curtain mounting bracket 10 of the first embodiment is used in conjunction with an upper beam 54 and a pair of blind bracket mounting devices 40A and 40B being substantially rectangular in shape. The first embodiment 10 is particularly used for attaching one or more standard flat curtain rods 12A and/or 12B in order to hold a curtain 14 and a valance 16, respectively, thereon. Each flat curtain rod 12A or 12B includes a pair of holding arms 22 and 24 and a holding section 30. Each holding arm 22 and 24 includes an opening 26 and 28, respectively, therein for receiving upper prong tab members 84 and 94 of each holding prong member 80 and 90, respectively, as depicted in FIGS. 1 and 3 of the drawings.

Figure 7:
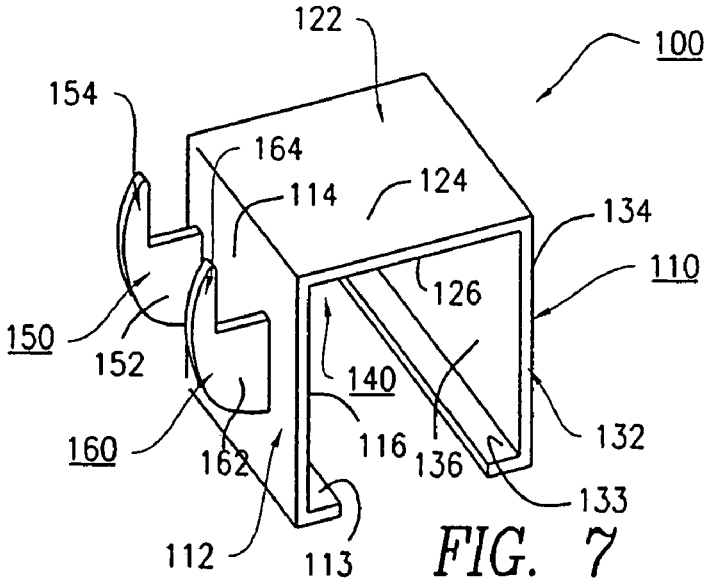
FIG. 7 is a perspective view of the blind/curtain mounting bracket of the second embodiment of the present invention showing holding prong members attached to a front holding wall member and the front holding wall member, a top holding wall member and a rear holding wall member being integrally connected with each other for forming a U-shaped interior holding wall member.
Figure 8:
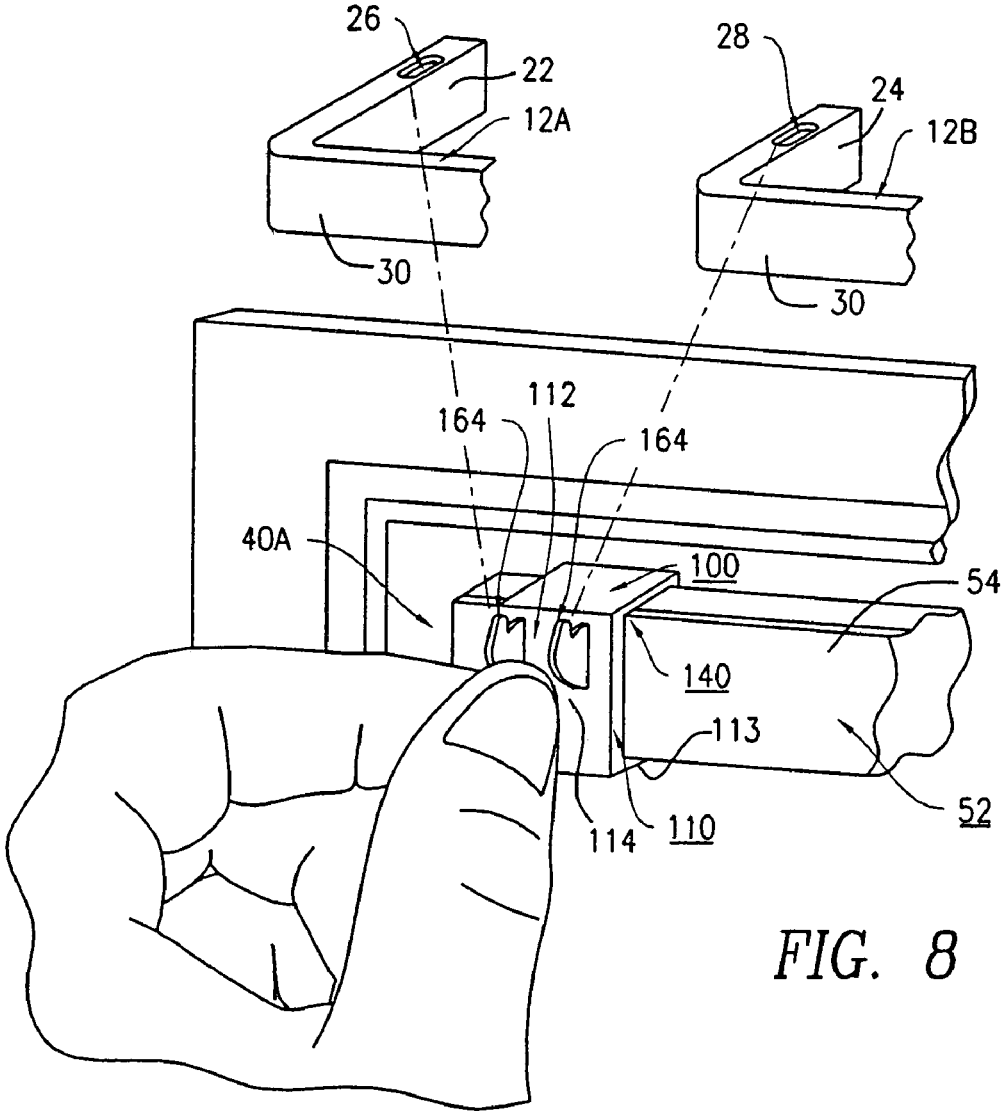
FIG. 8 is an exploded front perspective view of the blind/curtain mounting bracket of the second embodiment of the present invention showing the mounting bracket being placed within the blind bracket mounting device, and the flat curtain rods being attached to the holding prong members.

The blind/curtain mounting bracket 100 of the second embodiment is used in conjunction with an upper beam 54 of a blind mounting assembly 52 being substantially rectangular in shape. The second embodiment 100 is used for one or more standard flat curtain rods 12A and/or 12B in order to hold a curtain 14 and a valance 16, respectively, thereon. Each flat curtain rod 12A and 12B includes a pair of holding arms 22 and 24 and a holding section 30. Each holding arm 22 and 24 includes an opening 26 and 28, respectively, therein for receiving upper prong tab members 154 and 164 of each holding prong member 150 and 160, respectively, as depicted in FIGS. 7 and 8 of the drawings.

Figure 9:
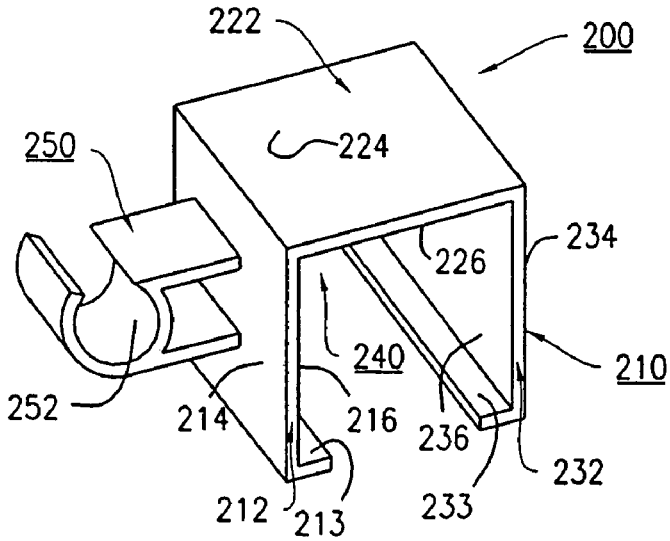
FIG. 9 is a perspective view of the blind/curtain mounting bracket of the third embodiment of the present invention showing a single rod holding section on a holding arm member being integrally attached to a front holding wall member, and the front holding wall member, a top holding wall member and a rear holding wall member being integrally connected with each other for forming a U-shaped interior holding wall member.
Figure 10:
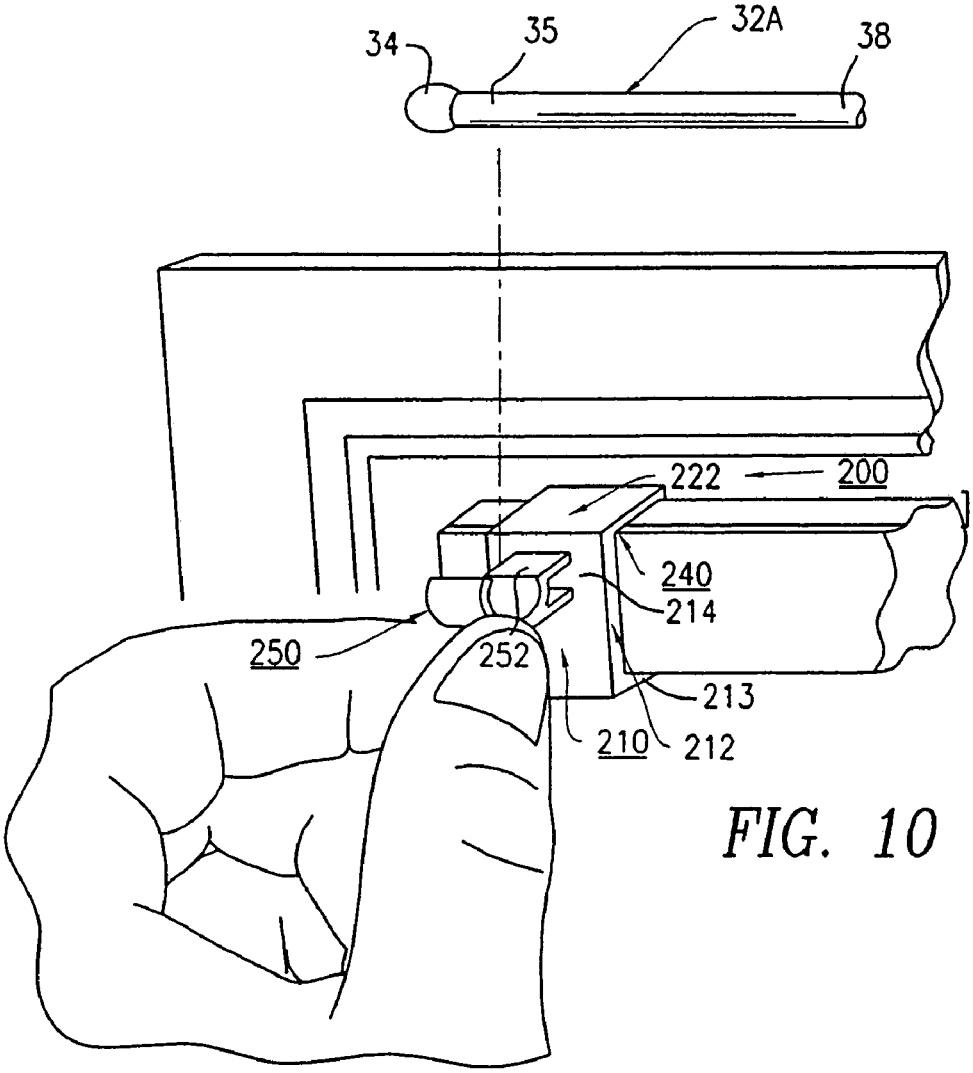
FIG. 10 is an exploded front perspective view of the blind/curtain mounting bracket of the third embodiment of the present invention showing the mounting bracket being within the blind bracket mounting device, and the cylindrical curtain rod being attached to the single rod holding section of the holding arm member.
Figure 12:
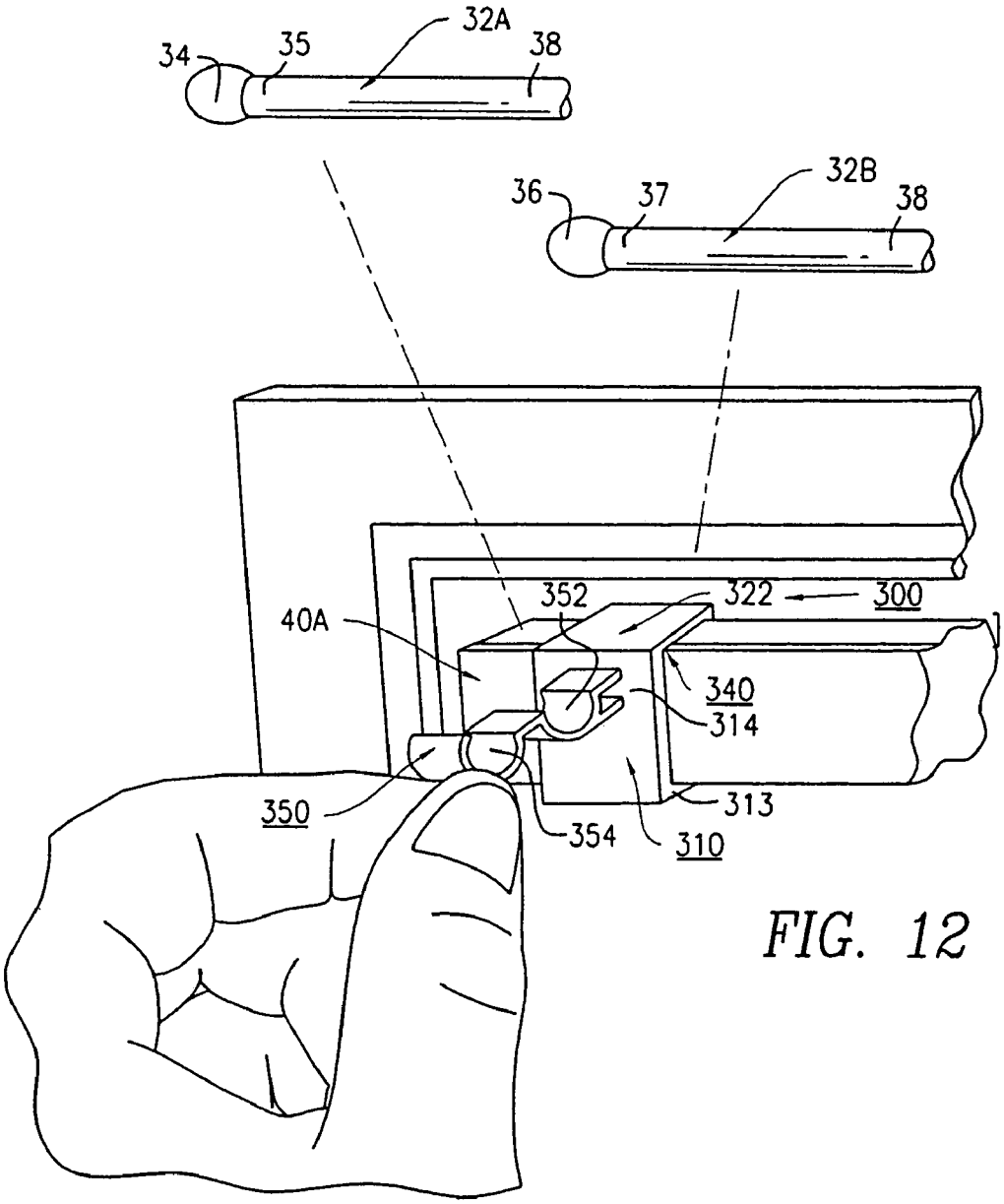
FIG. 12 is an exploded front perspective view of the blind/curtain mounting bracket of the fourth embodiment of the present invention showing the mounting bracket being within the blind bracket mounting device, and the cylindrical curtain rods being attached to the outer and inner rod holding sections of the holding arm member.

The blind/curtain mounting brackets 200 and 300 of the third and fourth embodiments are used in conjunction with an upper beam 54 of a blind mounting assembly 52 being substantially rectangular in shape. The third embodiment 200 is used for a single standard cylindrical curtain rod 32A for holding a curtain 14 or a valance 16 thereon. The fourth embodiment 300 is particularly used for attaching one or more standard cylindrical curtain rods 32A and/or 32B in order to hold a curtain 14 and/or a valance 16, respectively, thereon. Each cylindrical curtain rod 32A or 32B includes a holding knob 34 and 36 having at each end an end holding section 35 and 37, respectively, and a center holding section 38. Each end holding section 35 and 37 is, respectively, received within holding arm members 250 or 350, as depicted in FIGS. 10 and 12 of the drawings. The third and fourth embodiments 200 and 300 are similar in structure except for the holding arm members 250 and 350 being structurally different in configuration. Holding arm member 250 includes a single rod holding section 252 in which to hold a single cylindrical curtain rod 32A thereon, as shown in FIG. 9. Holding arm member 350 includes first (inner) and second (outer) rod holding sections 352 and 354 thereon for holding a pair cylindrical curtain rods 32A and 32B thereto, as shown in FIG. 12 of the drawings.

Figure 13:
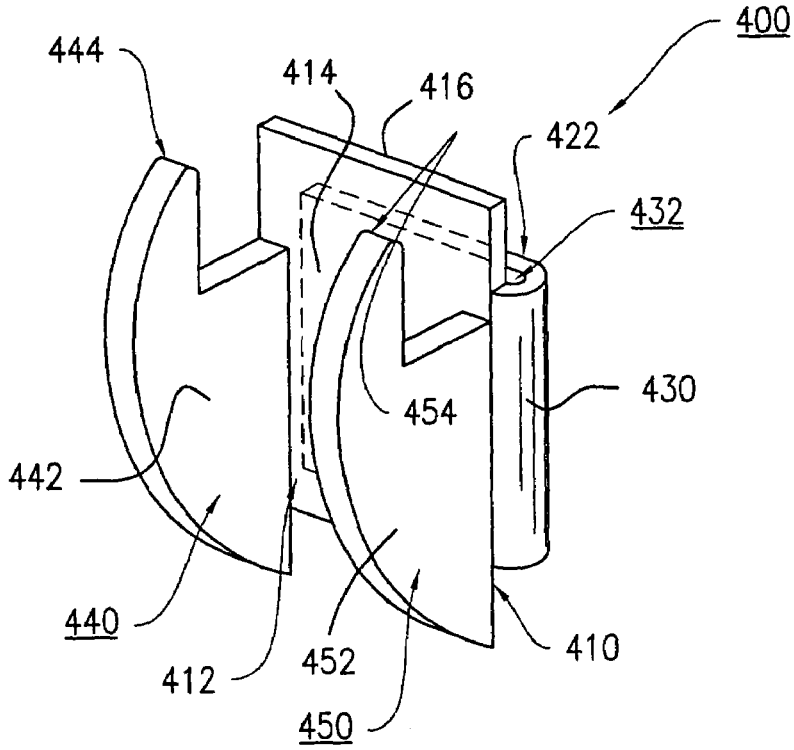
FIG. 13 is a front perspective view of the blind/curtain mounting bracket of the fifth embodiment of the present invention showing holding prong members attached to a front holding wall member and the front holding wall member and a rear holding wall member being integrally connected with each other for forming a holding wall clip member.
Figure 14:
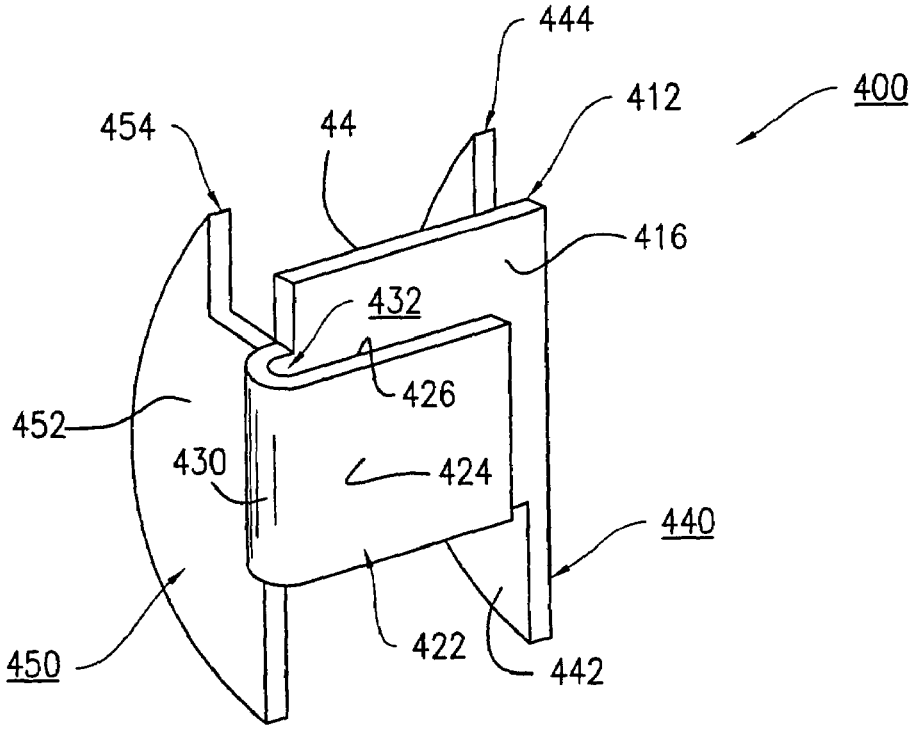
FIG. 14 is a rear perspective view of the blind/curtain mounting bracket of the fifth embodiment of the present invention showing the holding prong members attached to the front holding wall member, the rear wall member, and the holding wall clip member.
Figure 15:
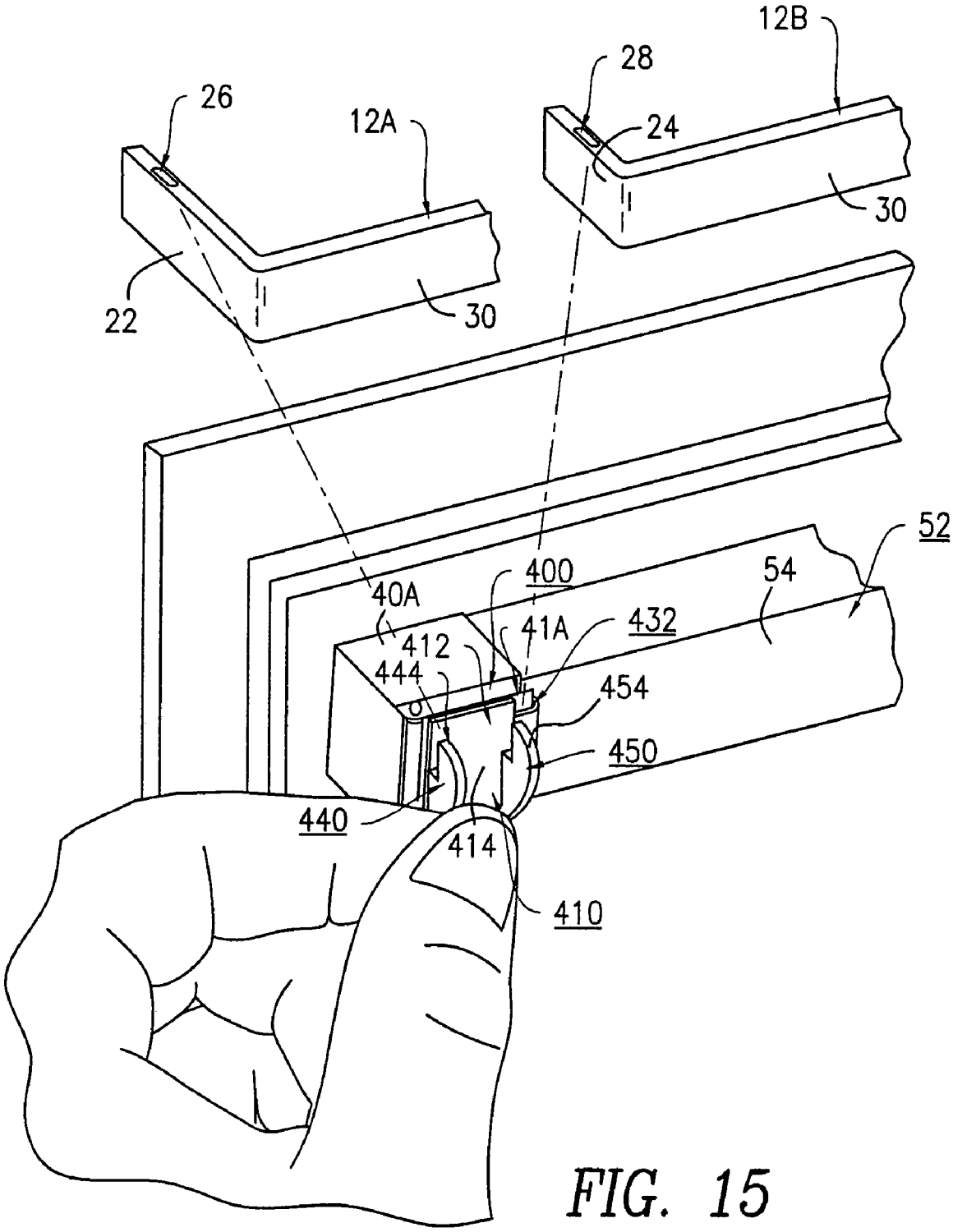
FIG. 15 is an exploded front perspective view of the blind/curtain mounting bracket of the fifth embodiment of the present invention showing the mounting bracket being connected within the blind bracket mounting device, and the flat curtain rods being attached to the holding prong members.
Figure 16:
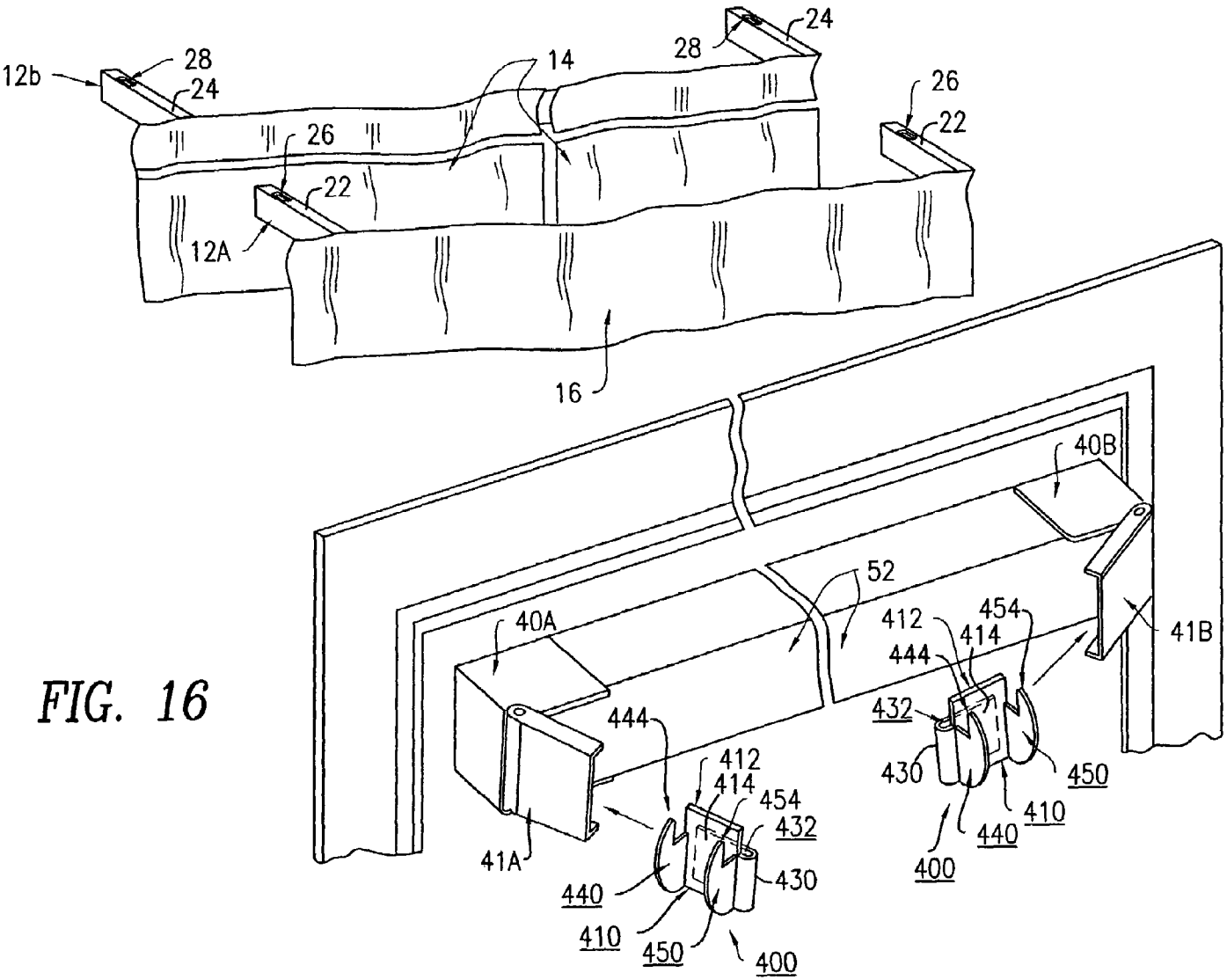
FIG. 16 is an exploded front perspective view of the blind/curtain mounting bracket of the fifth embodiment of the present invention showing the bind/curtain mounting brackets being assembled and readied for operational use.

The blind/curtain mounting bracket 400 of the fifth embodiment is used in conjunction with a pair of movable walls 41A and 41B of blind bracket mounting devices 40A and 40B of a blind mounting assembly 52 being substantially rectangular in shape. The fifth embodiment 400 is used for one or more standard flat curtain rods 12A and/or 12B in order to hold a curtain 14 and a valance 16, respectively, thereon. Each flat curtain rod 12A and 12B includes a pair of holding arms 22 and 24 and a holding section 30. Each holding arm 22 and 24 includes an opening 26 and 28, respectively, therein for receiving upper prong tab members 444 and 454 of each holding prong member 440 and 450, respectively, as depicted in FIGS. 13 and 14 of the drawings. A wall holding clip member 432 of mounting bracket 400 is detachably connected to each of the movable front walls 41A and 41B of blind bracket mounting devices 40A and 40B, respectively, as shown in FIGS. 15 and 16.

Figure 19:
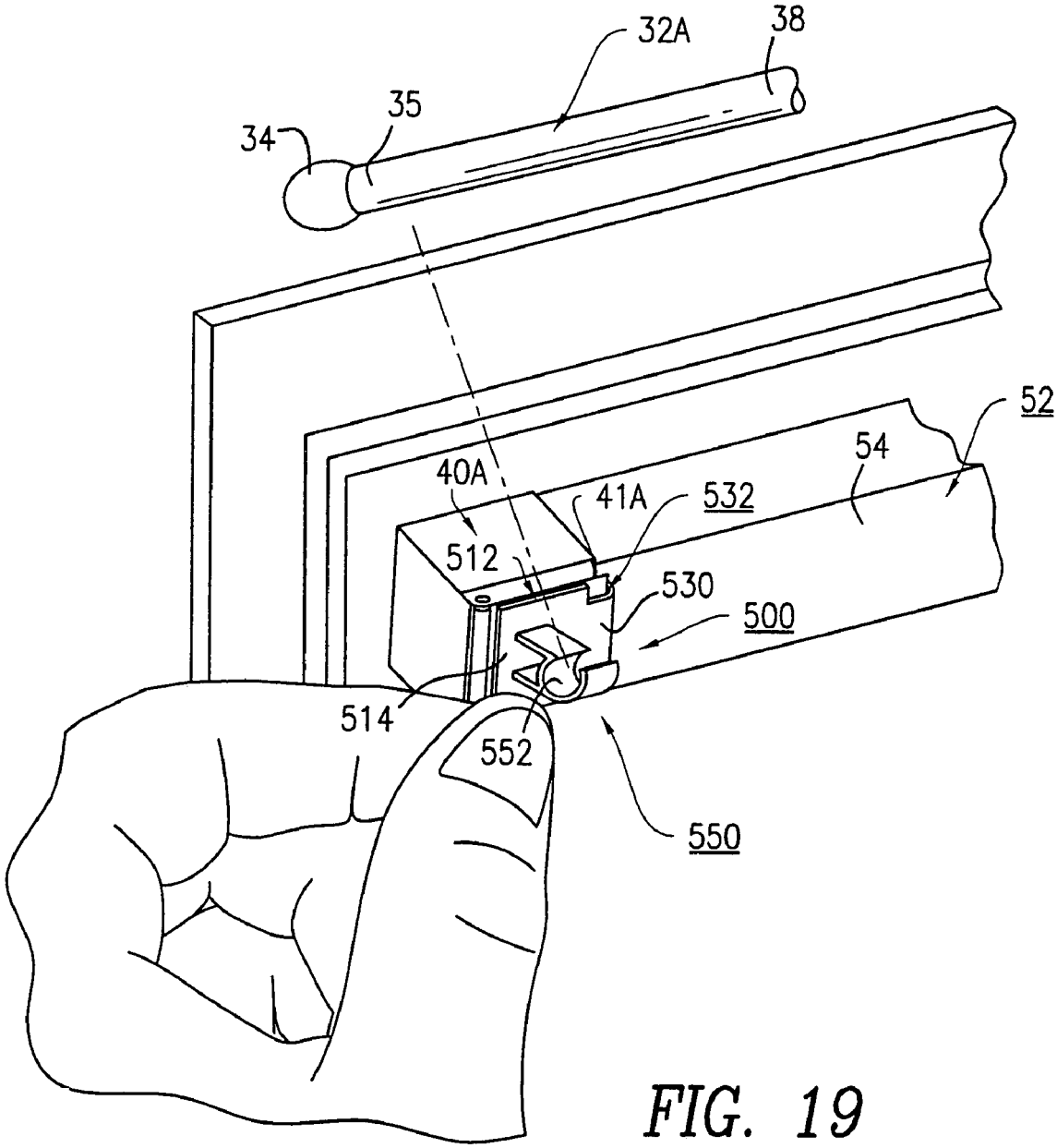
FIG. 19 is an exploded front perspective view of the blind/curtain mounting bracket of the sixth embodiment of the present invention showing the mounting bracket connected within the blind bracket mounting device, and one of the cylindrical curtain rods being attached to the single rod holding section on the holding section of the holding arm member.
Figure 20:
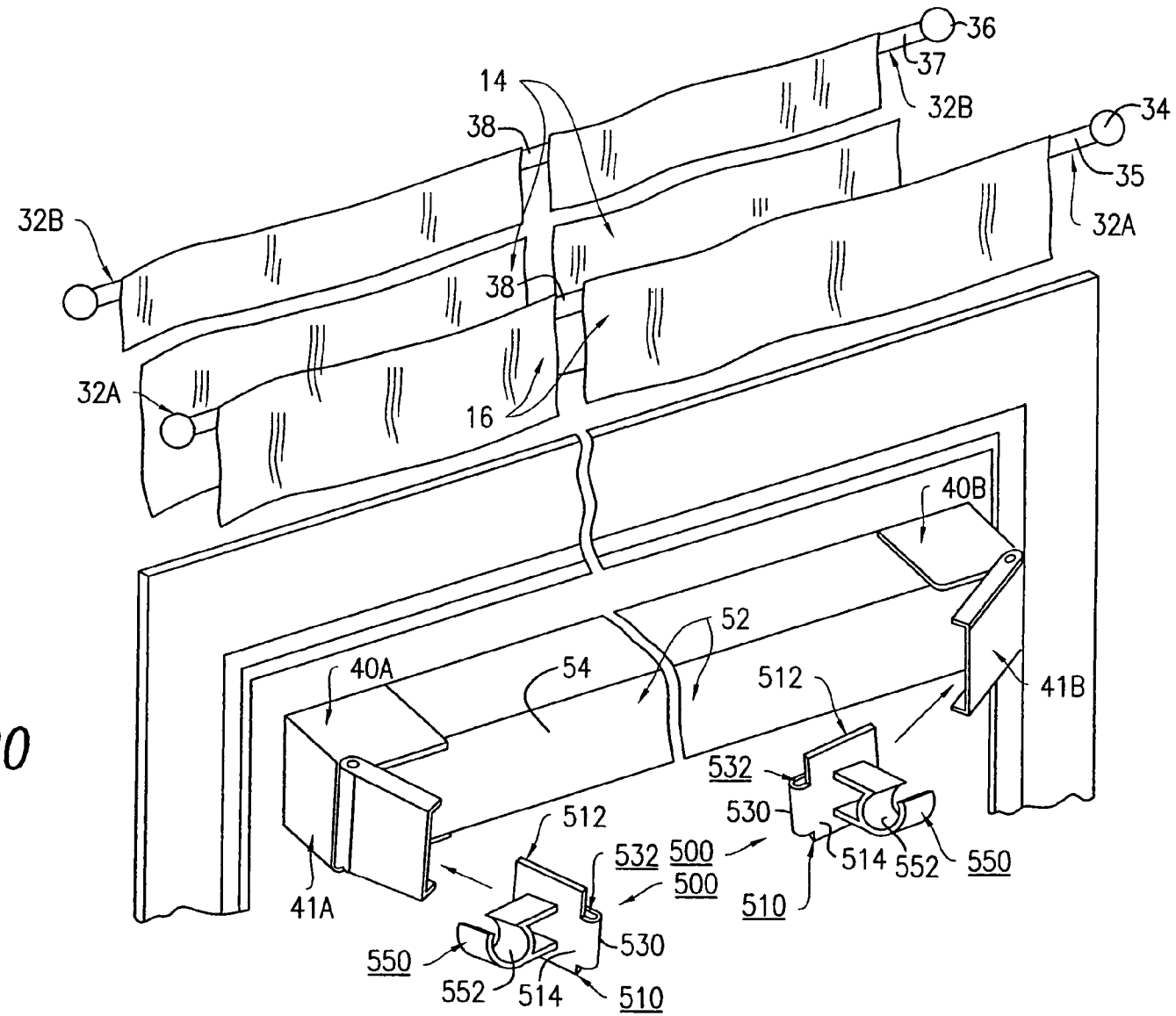
FIG. 20 is an exploded front perspective view of the blind/curtain mounting bracket of the sixth embodiment of the present invention showing the blind/curtain mounting brackets being assembled and readied for operational use.

The blind/curtain mounting brackets 500 and 600 of the sixth and seventh embodiments are used in conjunction with a pair of moveable walls 41A and 41B of blind bracket mounting devices 40A and 40B of a blind mounting assembly 52 being substantially rectangular in shape. The sixth embodiment 500 is used for a single standard cylindrical curtain rod 32A for holding a curtain 14 or a valance 16 thereon. The seventh embodiment 600 is particularly used for attaching one or more standard cylindrical curtain rods 32A and/or 32B in order to hold a curtain 14 and/or a valance 16, respectively, thereon. Each cylindrical curtain rod 32A or 32B includes a holding knob 34 and 36 having at each end an end holding section 35 and 37, respectively, and a center holding section 38. Each end holding section 35 and 37 is, respectively, received within holding arm members 550 or 650, as depicted in FIGS. 17 to 24 of the drawings. The sixth and seventh embodiments 500 and 600 are similar in structure except for the holding arm members 550 and 650 being structurally different in configuration. Holding arm member 550 includes a single rod holding section 552 in which to hold a single cylindrical curtain rod 32A thereon, as shown in FIG. 19. Holding arm member 650 includes first (inner) and second (outer) rod holding sections 652 and 654 thereon for holding a pair cylindrical curtain rods 32A and 32B thereto, as shown in FIG. 20 of the drawings. Wall holding clip members 532 and 632 of mounting brackets 500 and 600 are, respectively, detachably connected to each of the moveable front walls 41A and 41B of blind bracket mounting devices 40A and 40B, respectively, as shown in FIGS. 22 and 23.

The blind/curtain mounting brackets 700 and 800 of the eight and ninth embodiments are used in conjunction with a pair of moveable walls 41A and 41B of blind bracket mounting devices 40A and 40B of a blind mounting assembly 52 being substantially rectangular in shape, or to a front wall 53 of an upper beam 54 of the blind mounting assembly 52. The eighth embodiment 700 is used for a single standard cylindrical curtain rod 32A for holding a curtain 14 or a valance 16 thereon. The ninth embodiment 800 is particularly used for attaching one or more standard cylindrical curtain rods 32A and/or 32B in order to hold a curtain 14 and/or a valance 16, respectively, thereon. Each cylindrical curtain rod 32A or 32B includes a holding knob 34 and 36 having at each end an end holding section 35 and 37, respectively, and a center holding section 38. Each end holding section 35 and 37 is, respectively, received within holding arm members 750 or 850, as depicted in FIGS. 25 to 30 of the drawings. The eighth and ninth embodiments 700 and 800 are similar in structure except for the holding arm members 750 and 850 being structurally different in configuration. Holding arm member 750 includes a single rod holding section 752 in which to hold a single cylindrical curtain rod 32A thereon, as shown in FIG. 27. Holding arm member 850 includes first (inner) and second (outer) rod holding sections 852 and 854 thereon for holding a pair cylindrical curtain rods 32A and 32B thereto, as shown in FIG. 30 of the drawings. Wall holding clip members 732 and 832 of mounting brackets 700 and 800 are, respectively, detachably connected to each of the moveable front walls 41A and 41B of blind bracket mounting devices 40A and 40B, respectively, as shown in FIGS. 27 and 30.

It should be understood that the upper prong tab members 84 and 94, 154 and 164, and 444 and 454, may have different tab shapes, such as rounded tip shape (see FIG. 1), or a knife tip shape (see FIGS. 7 and 13) for sliding in or being received within channel openings 26 and 28 of the flat curtain rods 12A and 12B, respectively.

The blind/curtain mounting brackets 10, 100, 200, 300, 400, 500, 600, 700 and 800 can be made from durable and rigid molded plastics or light-weight stamped metals. The curtain mounting brackets 10, 100, 200, 300, 400, 500, 600, 700 and 800 become an integral component of the blind apparatus 52 and prevents the curtain rods 12A and 12B or 32A and 32 from falling out.

The front holding wall member 62, 112, 212, 312, 412, 512, 612, 712 and 812 of bracket housing 60, 110, 210, 310, 410, 510, 610, 710 and 810 has a height dimension of 1¼ inches, a width dimension of ⅞ of an inch, and a wall thickness dimension in the range of 1/32 to 1/16 of an inch. The holding prong members 80 and 90, 150 and 160, 440 and 450 of the front holding wall member 62, 112 and 412 has a height dimension of ¾ of an inch, a width dimension of ⅜ of an inch, and a wall thickness dimension in the range of 1/32 to 1/16 of an inch. The holding arm member 250, 550 or 750 has a width dimension of ⅜ of an inch and a length dimension of 1½ inches. The holding arm member 350, 650 or 850 has a width dimension of ⅜ of an inch and a length dimension of 2½ inches. Each of the rod holding sections 252, 352, 354, 552, 652, 654, 752, 852 or 854 are semicircular in shape and has a diameter in the range of 7/16 to ½ of an inch.

First Embodiment 10

Figure 5:
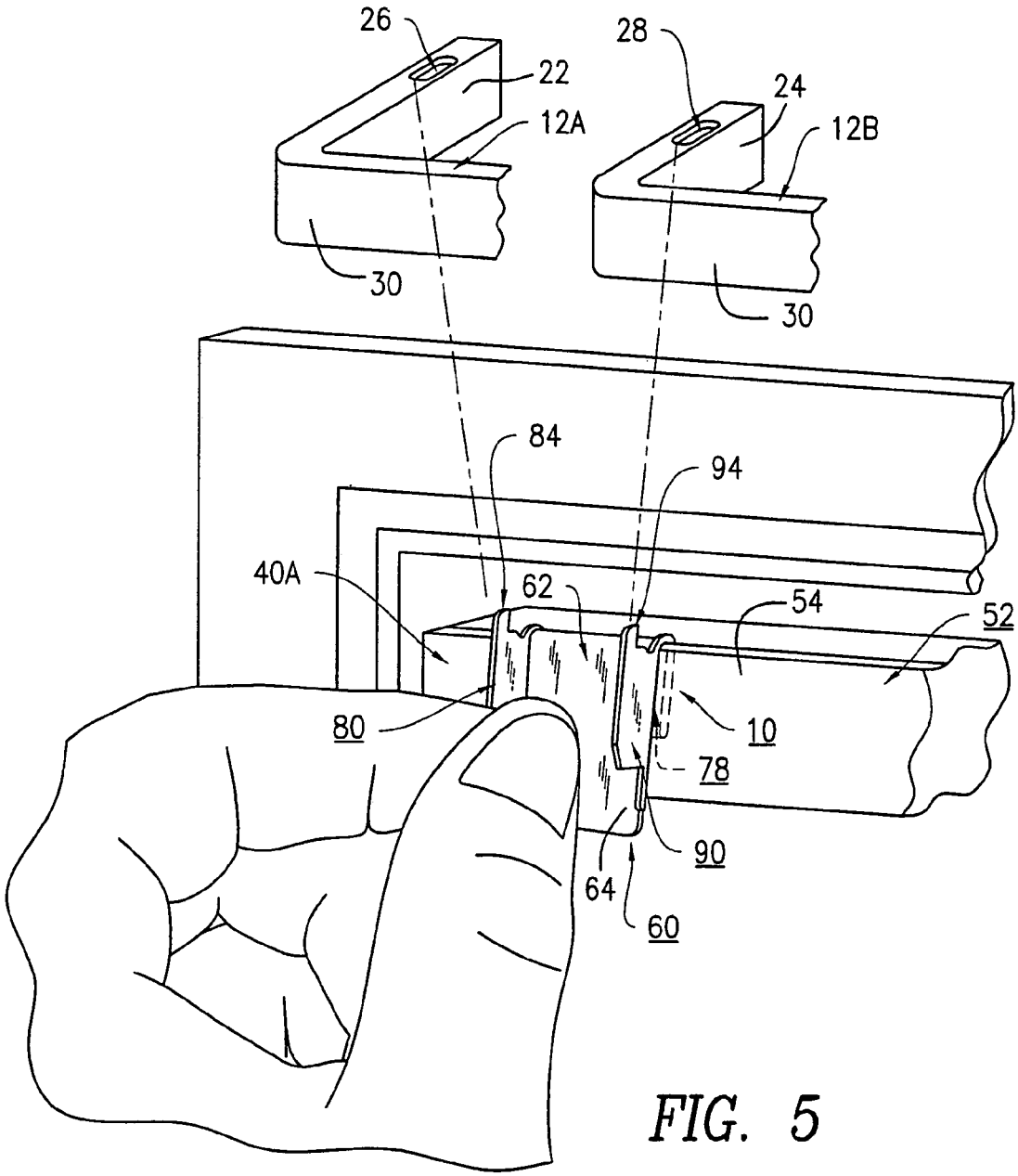
FIG. 5 is an exploded front perspective view of the blind/curtain mounting bracket of the first embodiment of the present invention showing the mounting bracket being connected within the blind bracket mounting device, and the flat curtain rods being attached to the holding prong members.
Figure 6:
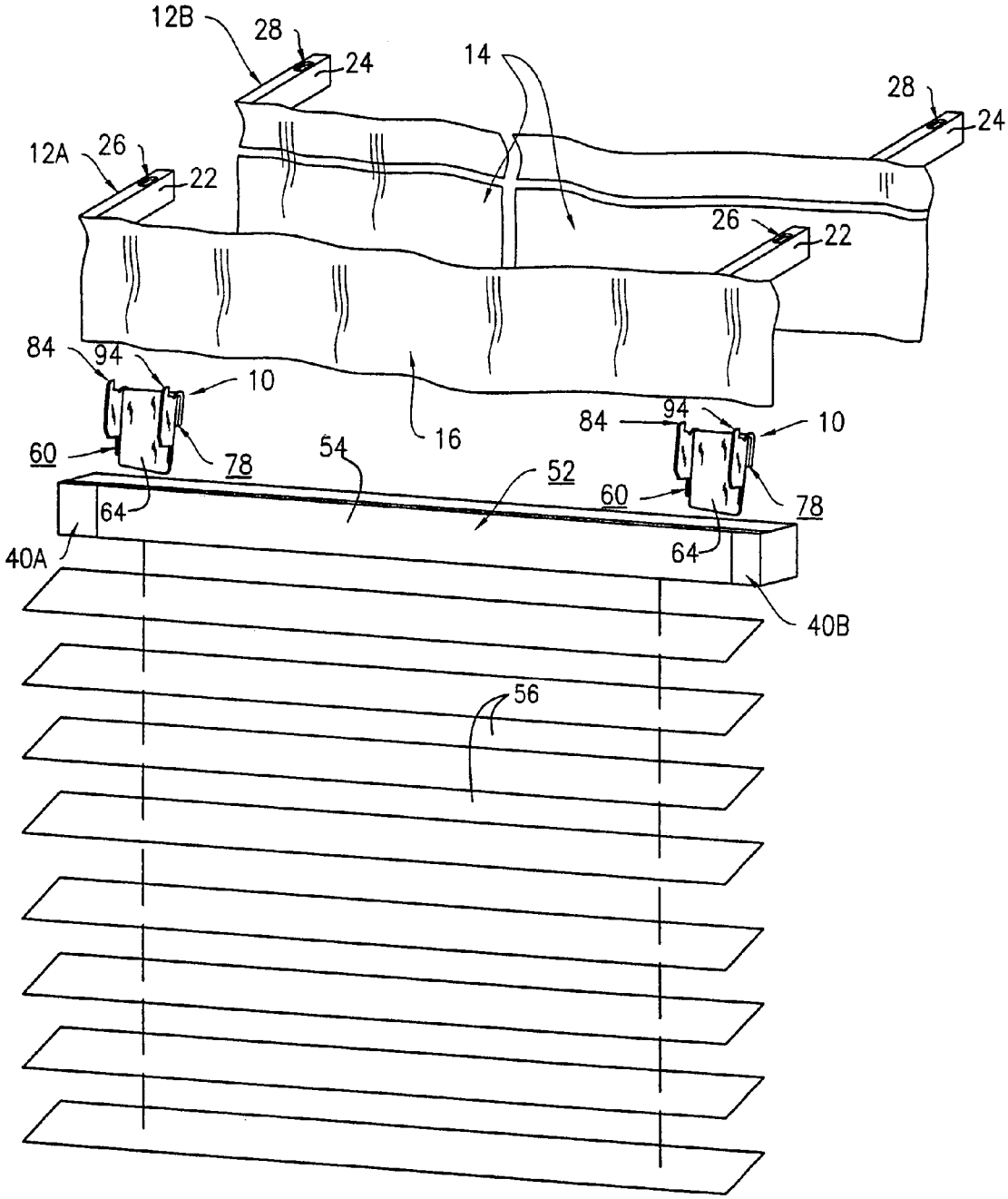
FIG. 6 is an exploded front perspective view of the blind/curtain mounting brackets of the first embodiment of the present invention showing the blind/curtain mounting brackets being assembled and readied for operational use.

The blind/curtain mounting bracket 10 and its component parts of the first embodiment of the present invention are represented in detail by FIGS. 1 through 6 of the patent drawings. The blind/curtain mounting brackets 10 are used for attaching one or more standard flat curtain rods 12A and/or 12B in conjunction with an upper beam 54 being between a pair of blind bracket mounting devices 40A and 40B of a blind mounting assembly 52 having a plurality of horizontal blind members 56 thereon, such that the flat curtain rods 12A and 12B are used to hold a curtain 14 and a valance 16 thereon, as depicted in FIGS. 5 and 6 of the drawings.

Figure 2:
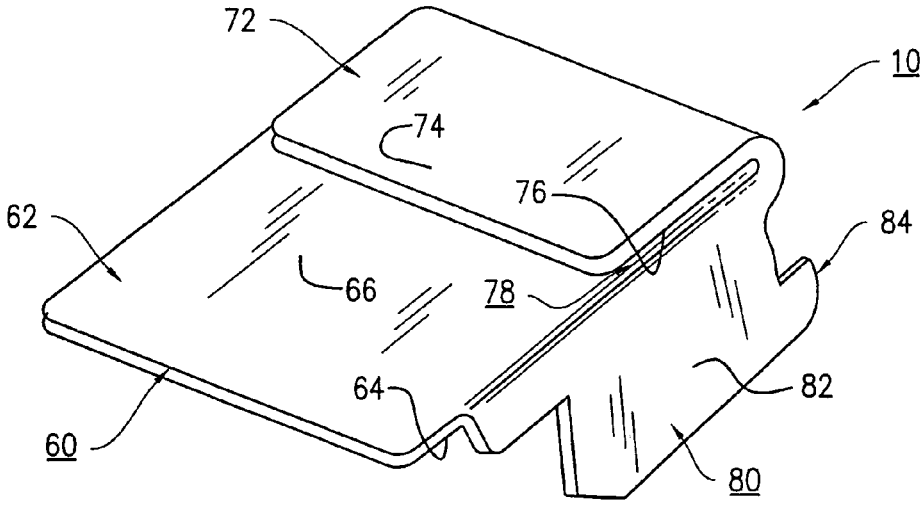
FIG. 2 is a rear perspective view of the blind/curtain mounting bracket of the first embodiment of the present invention showing one of the holding prong members attached to the front holding wall member, the rear holding wall member, and the holding wall clip member.
Figure 4:
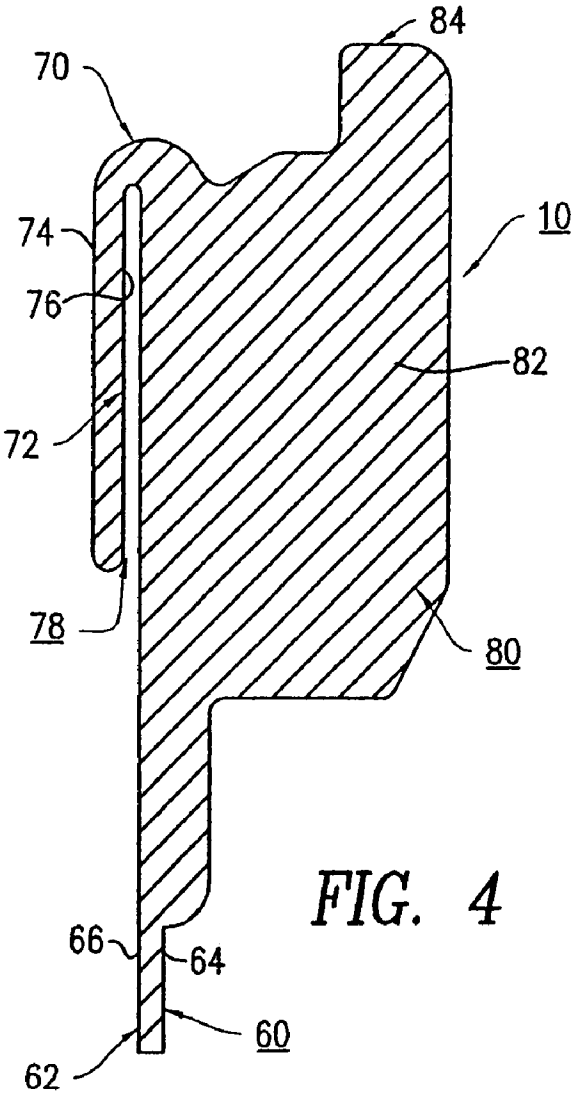
FIG. 4 is a cross-sectional view of the blind/curtain mounting bracket of the first embodiment of the present invention taken along lines 4—4 of FIG. 3 in the direction of the arrows showing the holding prong member, the front wall member and the rear holding wall member.
Figure 3:
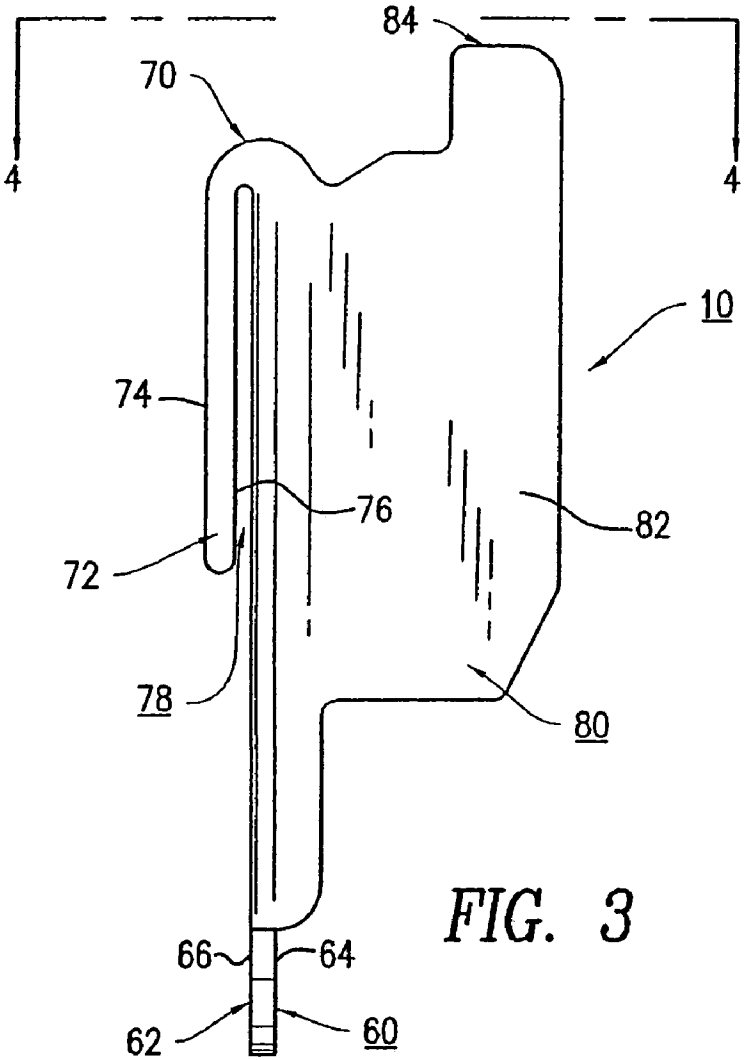
FIG. 3 is a side elevational view of the blind/curtain mounting bracket of the first embodiment of the present invention showing the holding prong member, the front holding wall member and the rear holding wall member.

Each blind/curtain mounting bracket 10 includes a bracket housing 60 having a front holding wall member 62 and a rear holding wall member 72 being integrally attached with each other at a joint upper seam section 70 for forming a holding wall clip member 78, as shown in FIGS. 1 and 2. Front holding wall member 62 includes a front exterior wall surface 64 and a rear interior wall surface 66 and rear holding wall member 72 includes a front exterior wall surface 74 and a rear interior wall surface 76. The front exterior wall surface 64 of front holding wall member 62 includes a pair of spaced-apart outer and inner holding prong members 80 and 90, respectively, being integrally connected to the front wall surface 64, as depicted in FIGS. 1 to 4 of the drawings. The integrally connected outer holding prong member 80 includes a prong holding side wall 82 having an upper prong tab member 84 thereon. The integrally connected inner holding prong member 90 includes a prong holding side wall 92 having an upper prong tab member 94 thereon. The upper prong tab members 84 and 94 are received within tab receiving openings 26 and 28 of each holding arm 22 and 24, respectively, of each of the standard flat curtain rods 12A and 12B, as shown in FIGS. 5 and 6 of the drawings. Additionally, each of the holding wall clip members 78 of blind/curtain mounting brackets 10 are detachably connected to the movable walls 41A and 41B of blind bracket mounting device 40A and 40B, or to a front wall 53 of the upper beam 54 of blind mounting assembly 52, respectively, as shown in FIG. 6.

Second Embodiment 100

The blind/curtain mounting bracket 100 and its component parts of the second embodiment of the present invention are represented in detail by FIGS. 7 and 8 of the patent drawings. The blind/curtain mounting brackets 100 are used for attaching one or more standard flat curtain rods 12A and/or 12B in conjunction with an upper beam 54 being between a pair of blind bracket mounting devices 40A and 40B of a blind mounting assembly 52 having a plurality of horizontal blind members 56 thereon, such that the flat curtain rods 12A and 12B are used to hold a curtain 14 and a valance 16 thereon, as depicted in FIGS. 7 and 8 of the drawings.

Each blind/curtain mounting bracket 100 includes a bracket housing 110 having a front holding wall member 112, a top holding wall member 122 and a rear holding wall member 132 all being integrally connected together with each other to form a U-shaped interior holding wall member 140 for mounting to the upper beam 54 of blind mounting assembly 52, as shown in FIG. 8 of the drawings. Front holding wall member 112 includes a front lip holding element 113 and rear holding wall member 132 includes a rear lip holding element 133 for additional mounting means for attaching to the upper beam 54 of blind mounting assembly 52, as shown in FIG. 8 of the drawings. Front holding wall member 112 includes a front exterior wall surface 114 and front interior wall surface 116. Top holding wall member 122 includes a top exterior wall surface 124 and a top interior wall surface 126. Rear holding wall member 132 includes a rear exterior wall surface 134 and a rear interior wall surface 136. The front exterior wall surface 114 of front holding wall member 112 includes a pair of spaced-apart outer and inner holding prong members 150 and 160 being integrally attached to the front exterior wall surface 114, respectively, as depicted in FIG. 7 of the drawings. The integrally attached outer holding prong member 150 includes a prong holding side wall 152 having an upper prong tab member 154 thereon. The integrally connected inner holding prong member 160 includes a prong holding side wall 162 having an upper prong tab member 164 thereon. The upper prong tab members 154 and 164 are received within tab receiving openings 26 and 28 of each holding arm 22 and 24, respectively, of each of the standard flat curtain rods 12A and 12B, as shown in FIG. 8 of the drawings.

Third Embodiment 200

The blind/curtain mounting bracket 200 and its component parts of the third embodiment of the present invention are represented in detail by FIGS. 9 and 10 of the patent drawings. The blind/curtain mounting brackets 200 are used for attaching a single standard cylindrical curtain rod 32A in conjunction with an upper beam 54 being between a pair of blind bracket mounting devices 40A and 40B of a blind mounting assembly 52 having a plurality of horizontal blind members 56 thereon, such that the single cylindrical curtain rod 32A is used to hold curtain 14 or a valance 16 thereon, as depicted in FIG. 10 of the drawings.

Each blind/curtain mounting bracket 200 includes a bracket housing 210 having a front holding wall member 212, a top holding wall member 222 and a rear holding wall member 232 all being integrally connected together with each other to form a U-shaped interior holding wall member 240 for mounting to the upper beam 54 of blind mounting assembly 52, as shown in FIGS. 9 and 10 of the drawings. Front holding wall member 212 includes a front lip holding element 213 and rear holding wall member 232 includes a rear lip holding element 233 for additional mounting means for attaching to the upper beam 54 of blind mounting assembly 52, as shown in FIG. 10 of the drawings. Front holding wall member 212 includes a front exterior wall surface 214 and front interior wall surface 216. Top holding wall member 222 includes a top exterior wall surface 224 and a top interior wall surface 226. Rear holding wall member 232 includes a rear exterior wall surface 234 and a rear interior wall surface 236. The front exterior wall surface 214 of front holding wall member 212 includes an integrally attached holding arm member 250 having a single rod holding section 252 thereon. The holding arm member 250 is centrally located on the front exterior wall surface 214 of front holding wall member 212, as depicted in FIG. 7 of the drawings. The holding arm member 250 is at a 90° degree angle with respect to the front exterior wall surface 214 of front holding wall member 212. The rod holding sections 252 are for receiving the end holding sections 35 and 37 of the single cylindrical curtain rod 32A, respectively, as shown in FIGS. 9 and 10 of the drawings.

Fourth Embodiment 300

Figure 11:
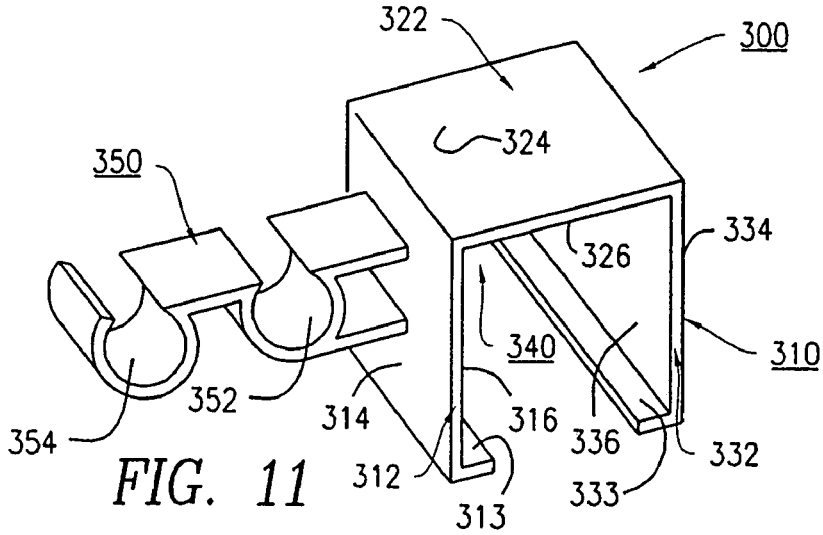
FIG. 11 is a perspective view of the blind/curtain mounting bracket of the fourth embodiment of the present invention showing outer and inner rod holding sections on a holding arm member being integrally attached to a front holding wall member, and the front holding wall member, a top holding wall member and a rear holding wall member being integrally connected with each other for forming a U-shaped interior holding wall member.

The blind/curtain mounting bracket 300 and its component parts of the third embodiment of the present invention are represented in detail by FIGS. 11 and 12 of the patent drawings. The blind/curtain mounting brackets 300 are used for attaching one or more standard cylindrical curtain rods 32A and/or 32B in conjunction with an upper beam 54 being between a pair of blind bracket mounting devices 40A and 40B of a blind mounting assembly 52 having a plurality of horizontal blind members 56 thereon, such that the standard cylindrical curtain rods 32A and 32B is used to hold curtain 14 and a valance 16 thereon, as depicted in FIG. 12 of the drawings.

Each blind/curtain mounting bracket 300 includes a bracket housing 310 having a front wall member 312, a top holding wall member 322 and a rear holding wall member 332 all being integrally connected together with each other to form a U-shaped interior holding wall member 340 for mounting to the upper beam 54 of blind mounting assembly 52, as shown in FIGS. 11 and 12 of the drawings. Front holding wall member 312 includes a front lip holding element 313 and rear holding wall member 332 includes a rear lip holding element 333 for additional mounting means for attaching to the upper beam 54 of blind mounting assembly 52, as shown in FIG. 12 of the drawings. Front holding wall member 312 includes a front exterior wall surface 314 and front interior wall surface 316. Top holding wall member 322 includes a top exterior wall surface 324 and a top interior wall surface 326. Rear holding wall member 332 includes a rear exterior wall surface 334 and a rear interior wall surface 336. The front exterior wall surface 314 of front holding wall member 312 includes an integrally attached holding arm member 350 having a pair of inner and outer rod holding sections 352 and 354 thereon. The holding arm member 350 is centrally located on the front exterior wall surface 314 of front holding wall member 312, as depicted in FIG. 11 of the drawings. The holding arm member 350 is at a 90° degree angle with respect to the front exterior wall surface 314 of front holding wall member 312. The rod holding sections 352 and 354 are for receiving the end holding sections 35 and 37 fo the standard cylindrical curtain rods 32A and/or 32B respectively, as shown in FIGS. 11 and 12 of the drawings.

Fifth Embodiment 400

The blind/curtain mounting bracket 400 and its component parts of the fifth embodiment of the present invention are represented in detail by FIGS. 13 to 16 of the patent drawings. The blind/curtain mounting brackets 400 are used for attaching one or more standard flat curtain rods 12A and/or 12B in conjunction with a pair of movable walls 41A and 41B of blind bracket mounting devices 40A and 40B of a blind mounting assembly 52 having a plurality of horizontal blind members 56 thereon, such that the flat curtain rods 12A and 12B are used to hold a curtain 14 and a valance thereon, as depicted in FIGS. 13, 14 and 15 of the drawings.

Each blind/curtain mounting bracket 400 includes a bracket housing 410 having a front holding wall member 412 and a rear holding wall member 422 being integrally attached with each other at a joint side seam section 430 for forming a wall holding clip member 432, as shown in FIG. 13. Front holding wall member 412 includes a front exterior wall surface 414 and a rear interior wall surface 416 and rear holding wall member 422 includes a front exterior wall surface 424 and a rear interior wall surface 426. The front exterior wall surface 414 of the front holding wall member 412 includes a pair of spaced-apart outer and inner holding prong members 440 and 450, respectively, being integrally connected to the front wall surface 414, as depicted in FIGS. 13 and 14 of the drawings. The inner holding prong member 450 is adjacent to the joint side seam section 430, as shown in FIG. 14. The integrally connected outer holding prong member 440 includes a prong holding side wall 442 having an upper prong tab member 444 thereon. The integrally connected inner holding prong member 450 includes a prong holding side wall 452 having an upper prong tab member 454 thereon. The upper prong tab members 444 and 454 are received within tab receiving openings 26 and 28 of each holding arm 22 and 24, respectively, of each of the standard flat curtain rods 12A and 12B, as shown in FIGS. 15 and 16 of the drawings. Additionally, wall holding clip member 432 is detachably connected to each of the movable front walls 41A and 41B of blind bracket mounting devices 40A and 40B, respectively, as depicted in FIGS. 15 and 16 of the drawings.

Sixth Embodiment 500

The blind/curtain mounting bracket 500 and its component parts of the sixth embodiment of the present invention are represented in detail by FIGS. 17 to 20 of the patent drawings. The blind/curtain mounting brackets 500 are used for attaching a single standard cylindrical curtain rod 32A in conjunction with a pair of movable walls 41A and 41B of blind bracket mounting devices 40A and 40B of a blind mounting assembly 52 having a plurality of horizontal blind members 56 thereon, such that the single cylindrical curtain rod 32A is used to hold a curtain 14 or a valance 16 thereon, as depicted in FIG. 19 of the drawings.

Figure 17:
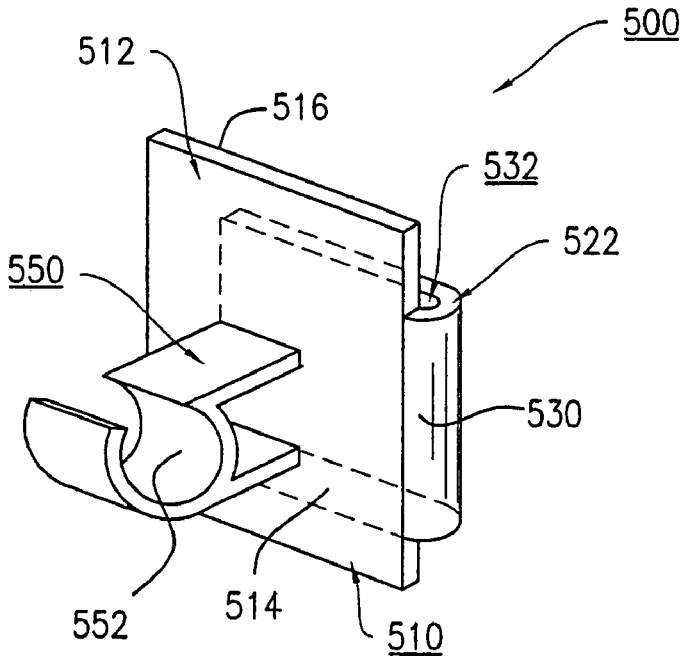
FIG. 17 is a front perspective view of the blind/curtain mounting bracket of the sixth embodiment of the present invention showing a single rod holding section on a holding arm member being integrally attached to a front holding wall member, and the front holding wall member and a rear holding wall member being integrally connected with each other for forming a holding wall clip member.
Figure 18:
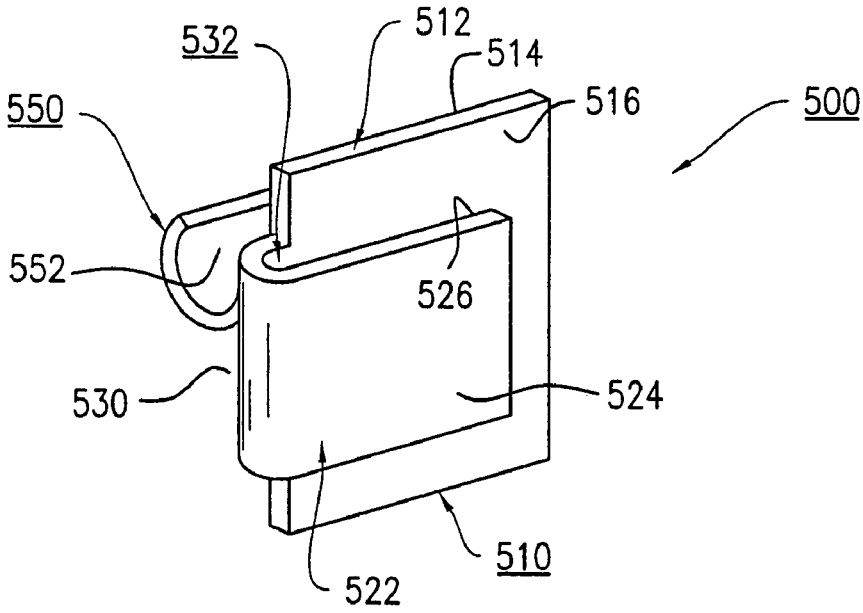
FIG. 18 is a rear perspective view of the blind/curtain mounting bracket of the sixth embodiment of the present invention showing the holding arm member attached to the front holding wall member, the rear holding wall member and the holding wall clip member.

Each blind/curtain bracket 500 includes a bracket housing 510 having a front holding wall member 512 and a rear holding wall member 522 being integrally attached with each other at a joint side seam section 530 for forming a wall holding clip member 532, as shown in FIG. 17. Front holding wall member 512 includes a front exterior wall surface 514 and a rear interior wall surface 516 and rear holding wall member 522 includes a front exterior wall surface 524 and a rear interior wall surface 526. The front exterior wall surface 514 of the front holding wall member 512 includes an integrally attached holding arm member 550 having a single rod holding section 552 thereon. The holding arm member 550 is centrally located on the front exterior wall surface 514 of front holding wall member 512, as depicted in FIG. 17 of the drawings. The holding arm member 550 is at a 90° degree angle with respect to the front exterior wall surface 514 of front holding wall member 512. The rod holding sections 552 are for receiving the end holding sections 35 and 37 of the single cylindrical curtain rod 32A, respectively, as shown in FIGS. 19 and 20 of the drawings. Additionally, wall holding clip member 532 is detachably connected to each of the movable front walls 41A and 41B of blind bracket mounting devices 40A and 40B, respectively, as depicted in FIGS. 19 and 20 of the drawings.

Seventh Embodiment 600

Figure 21:
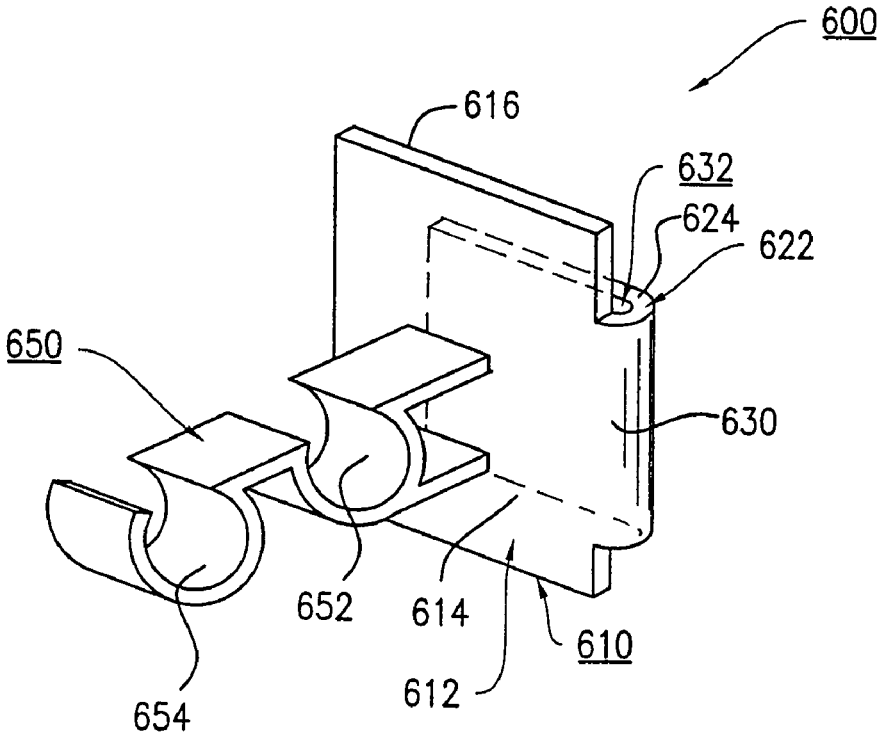
FIG. 21 is a front perspective view of the blind/curtain mounting bracket of the seventh embodiment of the present invention showing outer and inner rod holding sections on a holding arm member being integrally attached to a front holding wall member, and the front holding wall member and a rear holding wall member being integrally connected with each other for forming a holding wall clip member.
Figure 22:
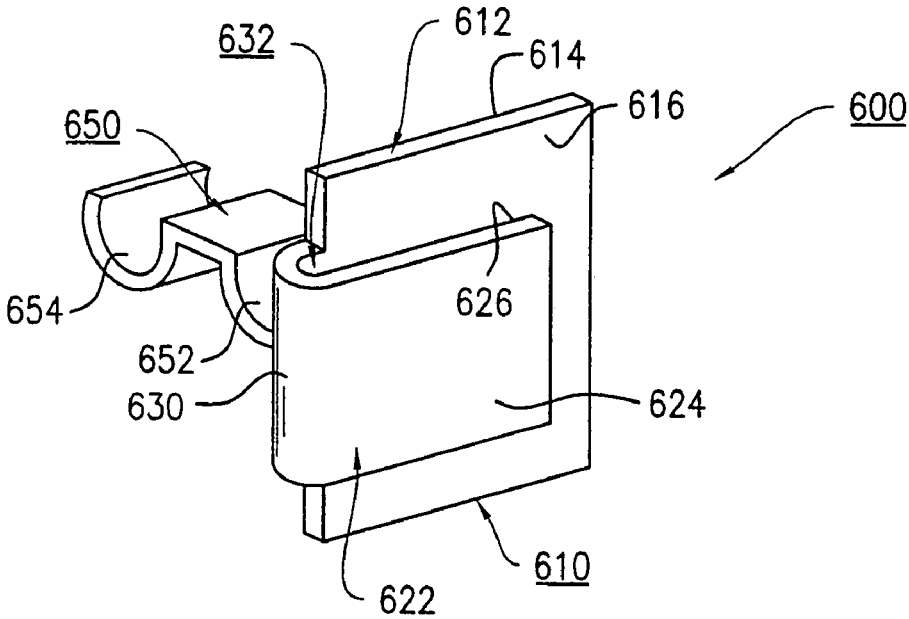
FIG. 22 is a rear perspective view of the blind/curtain mounting bracket of the seventh embodiment showing the holding arm member attached to the front holding wall member, the rear holding wall member and the holding wall clip member.
Figure 23:
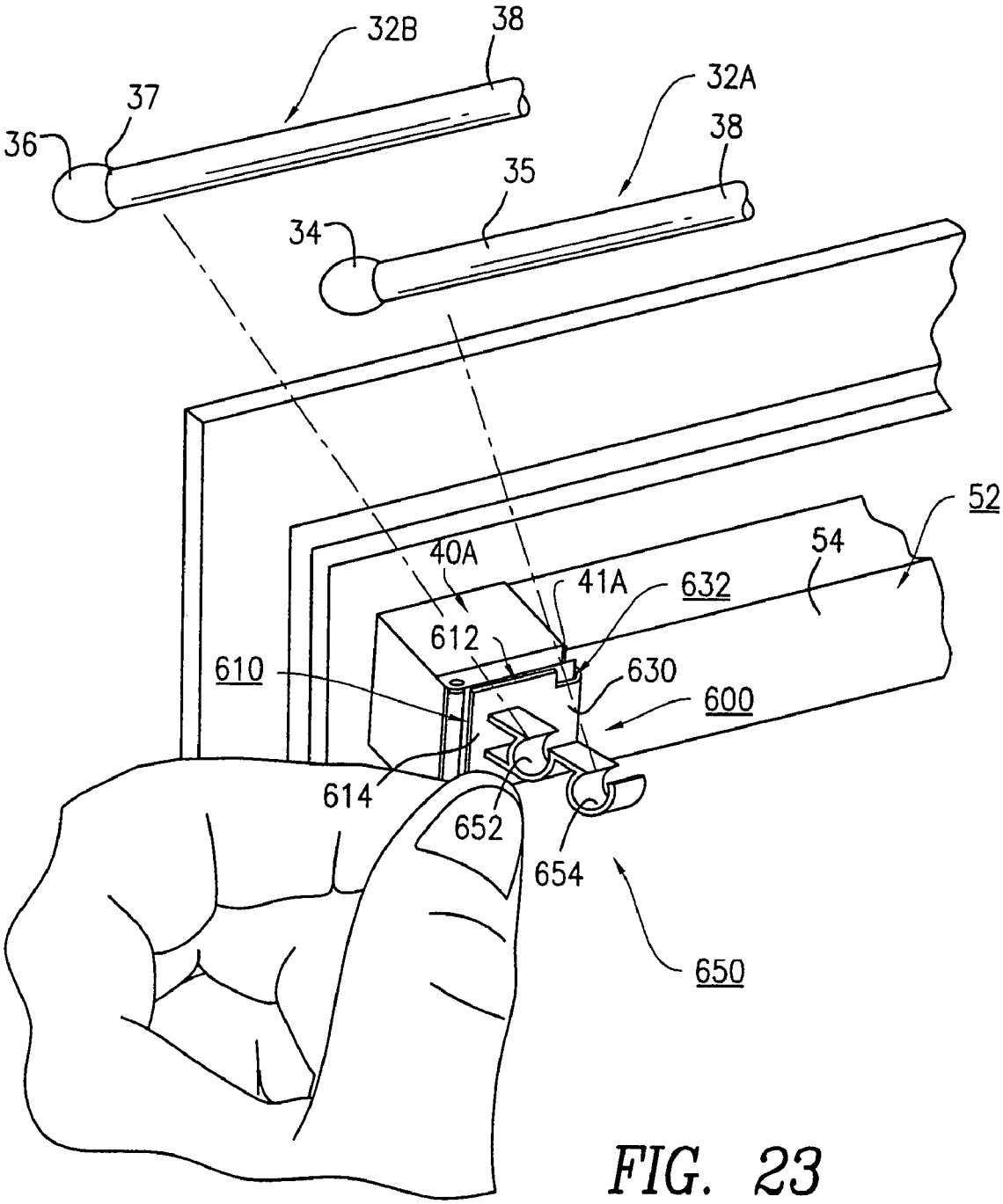
FIG. 23 is an exploded perspective view of the blind/curtain mounting bracket of the seventh embodiment of the present invention showing the mounting bracket connected within the blind bracket mounting device, and each of the cylindrical curtain rods being attached to the outer and inner rod holding sections on the holding arm member.

The blind/curtain mounting bracket 600 and its component parts of the seventh embodiment of the present invention are represented in detail by FIGS. 21 to 24 of the patent drawings. The blind/curtain mounting brackets 600 are used for attaching one or more standard cylindrical curtain rods 32A and/or 32B in conjunction with a pair of movable walls 41A and 41B of blind bracket mounting devices 40A and 40B of blind mounting assembly 52 having a plurality of horizontal blind members 56 thereon, such that the standard cylindrical curtain rods 32A and 32B are used to hold a curtain 14 and a valance 16 thereon, as depicted in FIG. 21 of the drawings.

Figure 24:
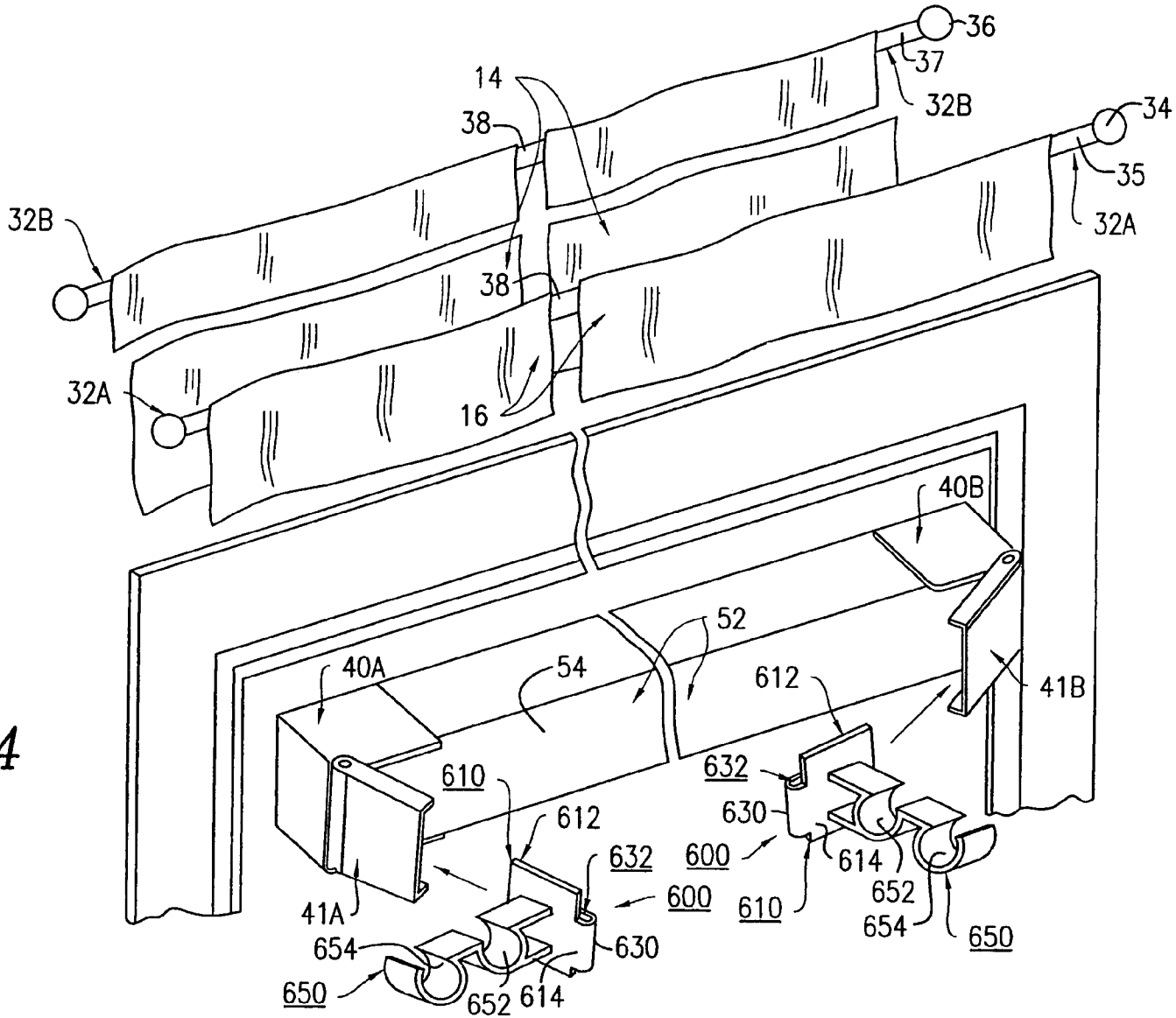
FIG. 24 is an exploded front perspective view of the blind/curtain mounting bracket of the seventh embodiment of the present invention showing the blind/curtain mounting brackets being assembled and readied for operational use.

Each blind/curtain mounting bracket 600 includes a bracket housing 610 having a front holding wall member 612 and a rear holding wall member 622 being integrally attached with each other at a joint side seam section 630 for forming a wall holding clip member 632, as shown in FIG. 22. Front holding wall member 612 includes a front exterior wall surface 614 and a rear interior wall surface 616 and rear holding wall member 622 includes a front exterior wall surface 624 and a rear interior wall surface 626. The front exterior wall surface 614 of the front holding wall member 612 includes an integrally attached holding arm member 650 having a pair of inner and outer rod holding sections 652 and 654 thereon. The holding arm member 650 is centrally located on the front exterior wall surface 614 of front holding wall member 612, as depicted in FIG. 21 of the drawings. The holding arm member 650 is at a 90° degree angle with respect to the front exterior wall surface 614 of front holding wall member 612. The rod holding sections 652 and 654 are for receiving the end holding sections 35 and 37 fo the standard cylindrical curtain rods 32A and/or 32B respectively, as shown in FIGS. 22 and 23 of the drawings. Additionally, wall holding clip member 632 is detachably connected to each of the movable front walls 41A and 41B of blind bracket mounting devices 40A and 40B, respectively, as depicted in FIGS. 23 and 24 of the drawings.

Eighth Embodiment 700

Figure 25:
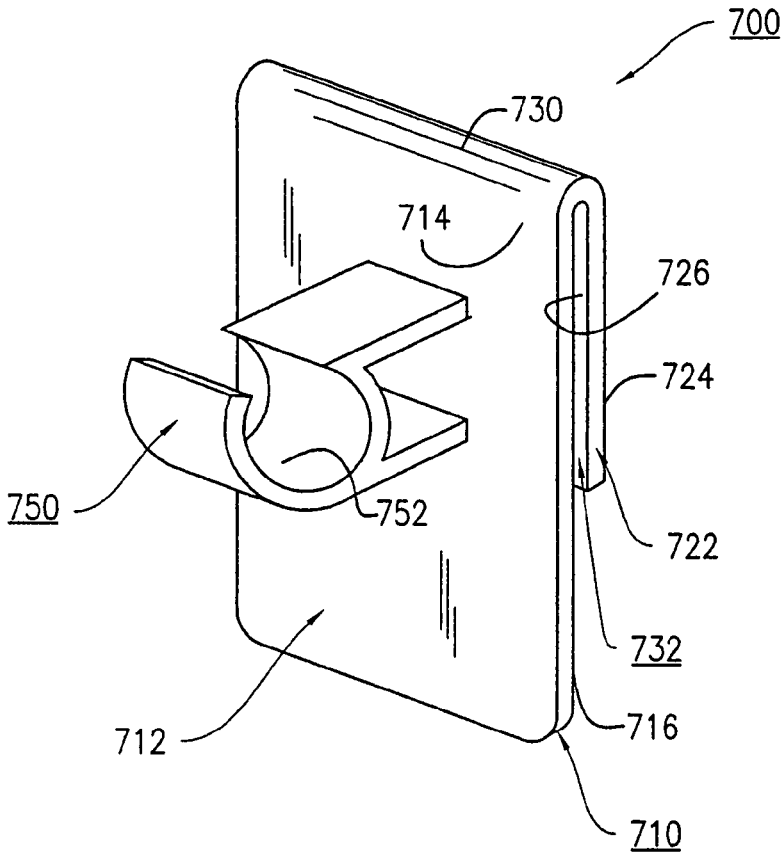
FIG. 25 is a front perspective view of the blind/curtain mounting bracket of the eighth embodiment of the present invention showing a single rod holding section on a holding arm member being integrally attached to a front holding wall member, and the front holding wall member and a rear holding wall member being integrally connected with each other for forming a holding wall clip member.
Figure 26:
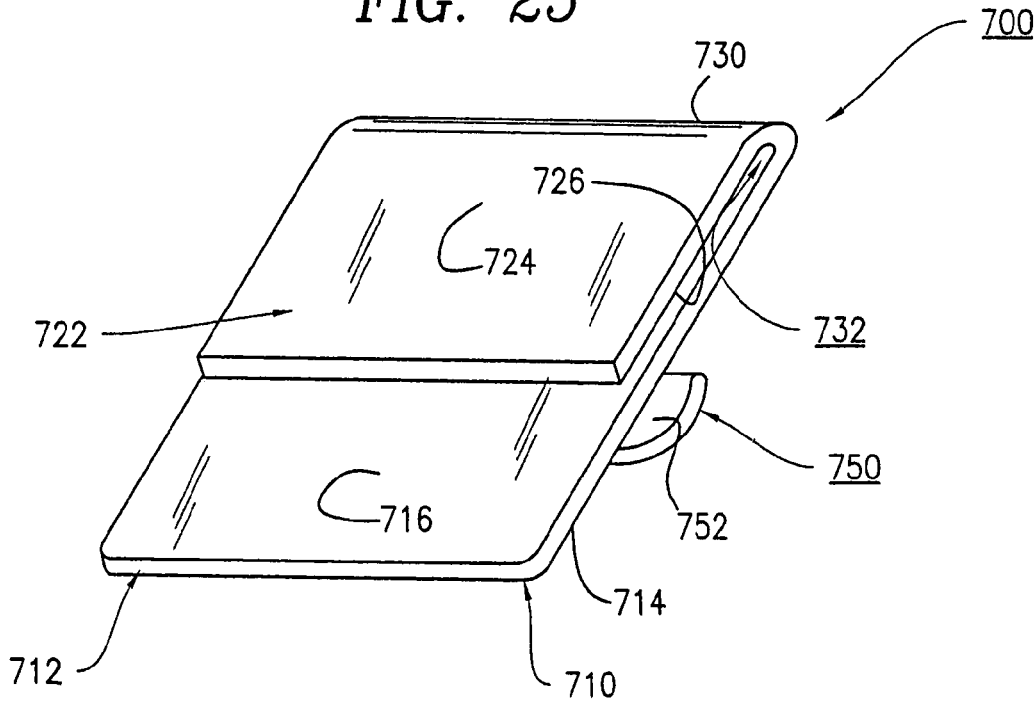
FIG. 26 is a rear perspective view of the blind/curtain mounting bracket of the eighth embodiment of the present invention showing the holding arm member attached to the front holding wall member, the rear holding wall member and the holding wall clip member.
Figure 27:
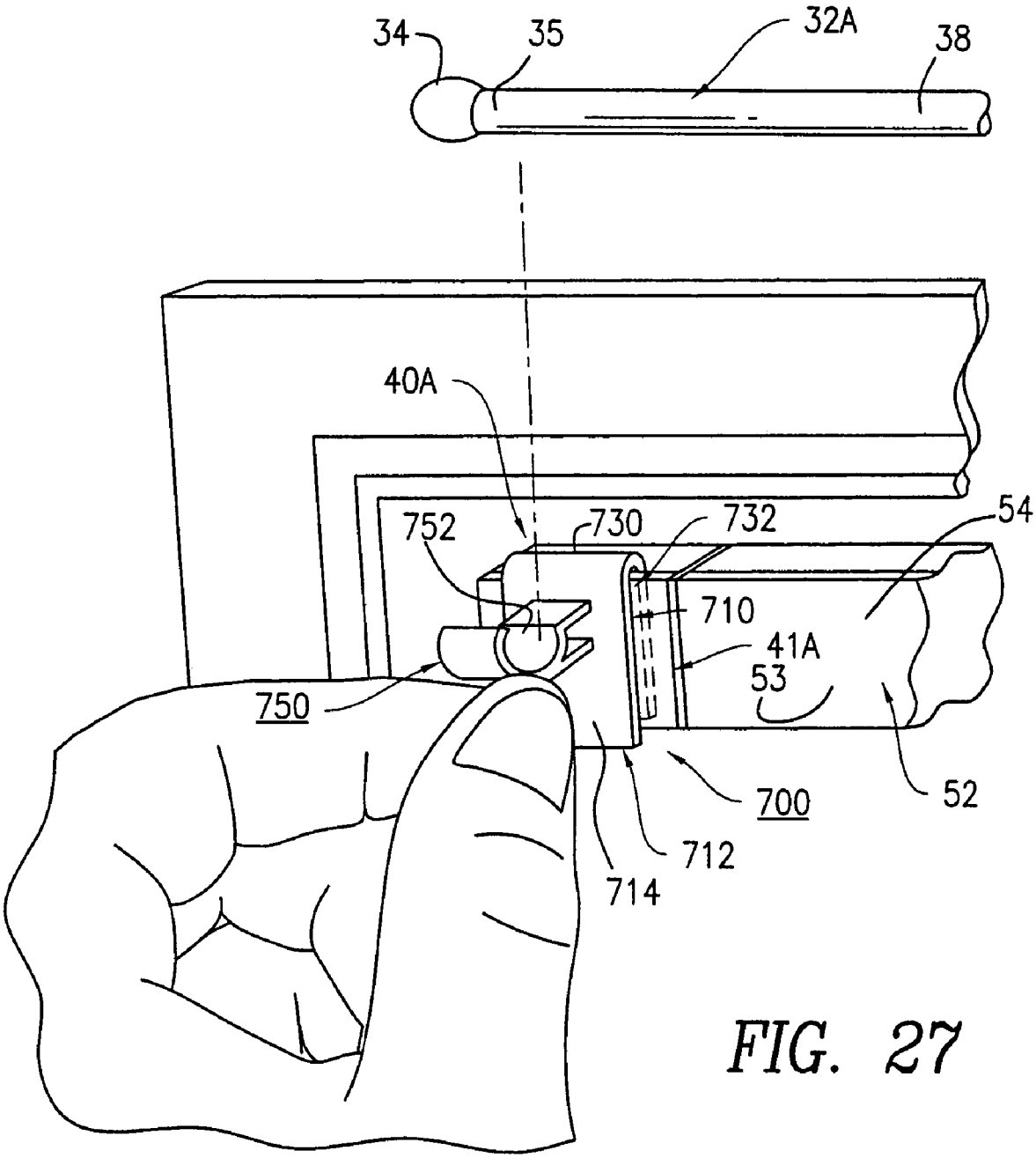
FIG. 27 is an exploded front perspective view of the blind/curtain mounting bracket of the eighth embodiment of the present invention showing the mounting bracket connected within the blind bracket mounting device, and one of the cylindrical curtain rods being attached to the single rod holding section on the holding section of the holding arm member.

The blind/curtain mounting bracket 700 and its component parts of the sixth embodiment of the present invention are represented in detail by FIGS. 25 to 27 of the patent drawings. The blind/curtain mounting brackets 700 are used for attaching a single standard cylindrical curtain rod 32A in conjunction with a pair of movable walls 41A and 41B of blind bracket mounting devices 40A and 40B of a blind mounting assembly 52 having a plurality of horizontal blind members 56 thereon, such that the single cylindrical curtain rod 32A is used to hold a curtain 14 or a valance 16 thereon, as depicted in FIG. 27 of the drawings.

Each blind/curtain bracket 700 includes a bracket housing 710 having a front holding wall member 712 and a rear holding wall member 722 being integrally attached with each other at a joint upper seam section 730 for forming a wall holding clip member 732, as shown in FIG. 25. Front holding wall member 712 includes a front exterior wall surface 714 and a rear interior wall surface 716 and rear holding wall member 722 includes a front exterior wall surface 724 and a rear interior wall surface 726. The front exterior wall surface 714 of the front holding wall member 712 includes an integrally attached holding arm member 750 having a single rod holding section 752 thereon. The holding arm member 750 is centrally located on the front exterior wall surface 714 of front holding wall member 712, as depicted in FIG. 25 of the drawings. The holding arm member 750 is at a 90° degree angle with respect to the front exterior wall surface 714 of front holding wall member 712. The rod holding sections 752 are for receiving the end holding sections 35 and 37 of the single cylindrical curtain rod 32A, respectively, as shown in FIG. 27 of the drawings. Additionally, wall holding clip member 732 is detachably connected to each of the movable front walls 41A and 41B of blind bracket mounting devices 40A and 40B, or to a front wall 53 of the upper beam 54 of blind mounting assembly 52, respectively, as depicted in FIG. 27 of the drawings.

Ninth Embodiment 800

Figure 28:
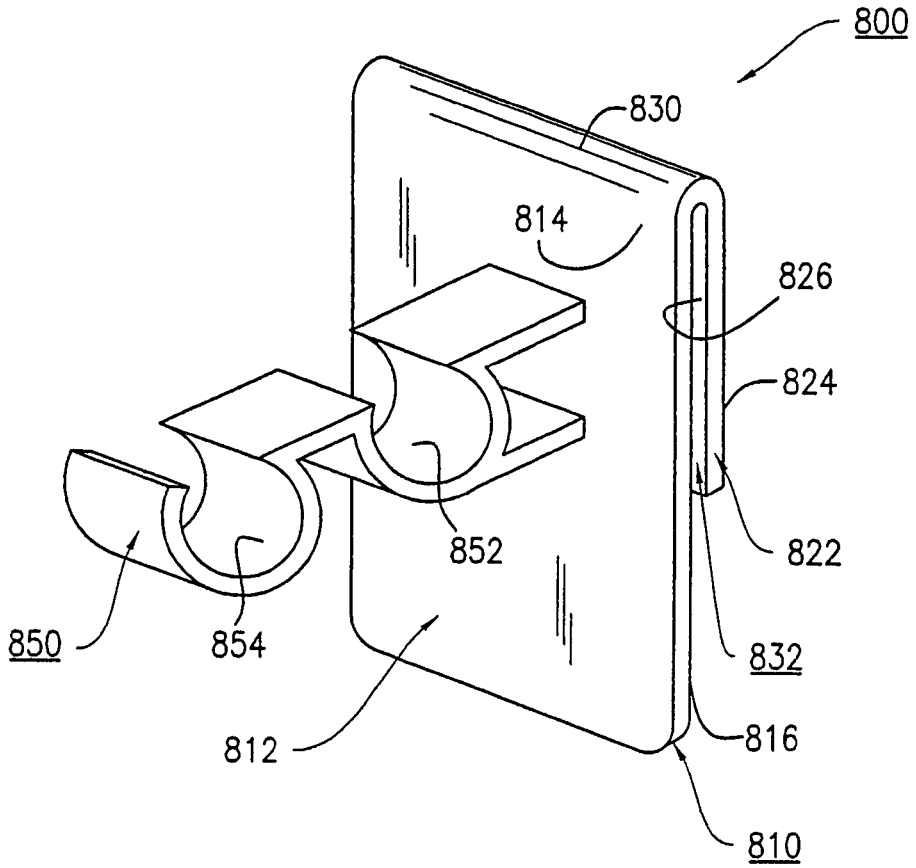
FIG. 28 is a front perspective view of the blind/curtain mounting bracket of the ninth embodiment of the present invention showing outer and inner rod holding sections on a holding arm member being integrally attached to a front holding wall member, and the front holding wall member and a rear holding wall member being integrally connected with each other for forming a holding wall clip member.
Figure 29:
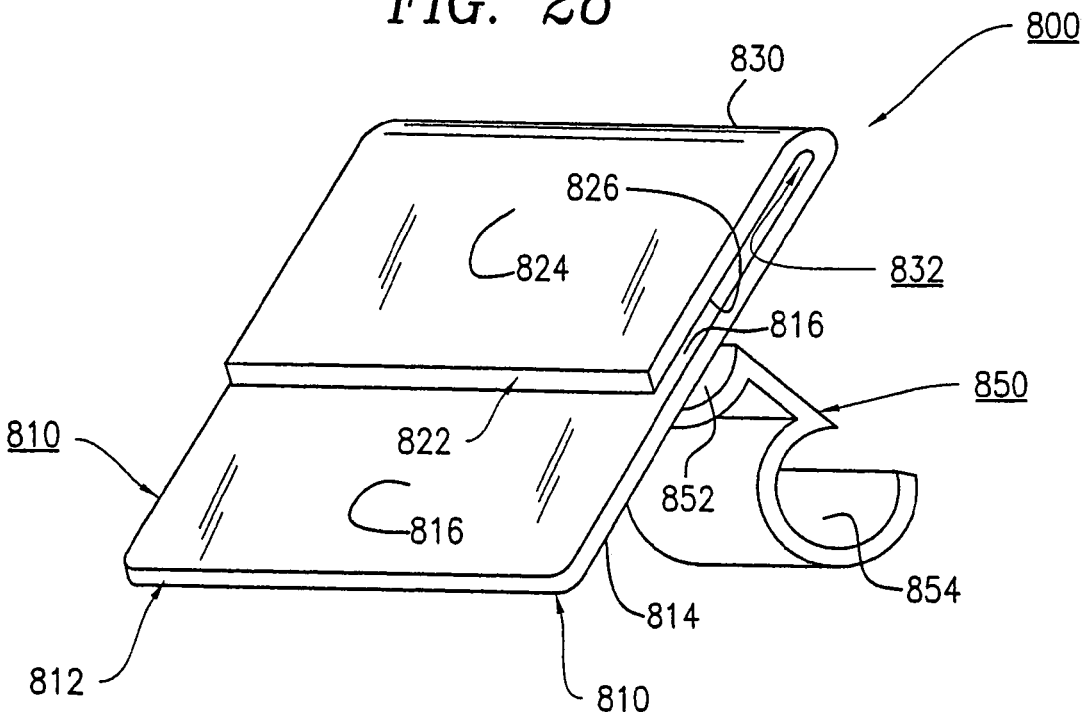
FIG. 29 is a rear perspective view of the blind/curtain mounting bracket of the ninth embodiment showing the holding arm member attached to the front holding wall member, the rear holding wall member and the holding wall clip member.
Figure 30:
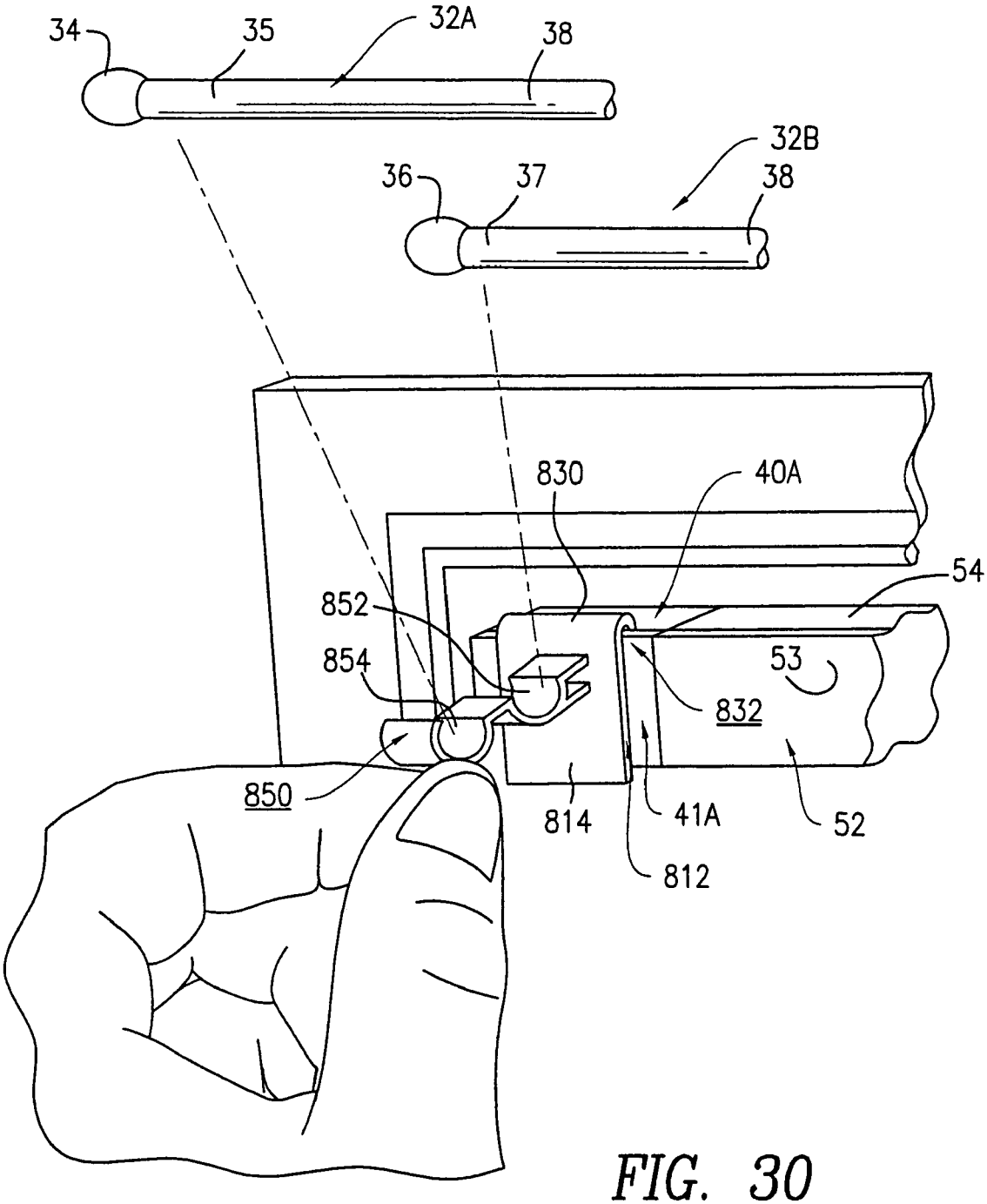
FIG. 30 is an exploded perspective view of the blind/curtain mounting bracket of the ninth embodiment of the present invention showing the mounting bracket connected within the blind bracket mounting device, and each of the cylindrical curtain rods being attached to the outer and inner rod holding sections on the holding arm member.

The blind/curtain mounting bracket 800 and its component parts of the seventh embodiment of the present invention are represented in detail by FIGS. 28 to 30 of the patent drawings. The blind/curtain mounting brackets 800 are used for attaching one or more standard cylindrical curtain rods 32A and/or 32B in conjunction with a pair of movable walls 41A and 41B of blind bracket mounting devices 40A and 40B of blind mounting assembly 52 having a plurality of horizontal blind members 56 thereon, such that the standard cylindrical curtain rods 32A and 32B are used to hold a curtain 14 and a valance 16 thereon, as depicted in FIG. 30 of the drawings.

Each blind/curtain mounting bracket 800 includes a bracket housing 810 having a front holding wall member 812 and a rear holding wall member 822 being integrally attached with each other at a joint upper seam section 830 for forming a wall holding clip member 832, as shown in FIG. 28. Front holding wall member 812 includes a front exterior wall surface 814 and a rear interior wall surface 816 and rear holding wall member 822 includes a front exterior wall surface 824 and a rear interior wall surface 826. The front exterior wall surface 814 of the front holding wall member 812 includes an integrally attached holding arm member 850 having a pair of inner and outer rod holding sections 852 and 854 thereon. The holding arm member 850 is centrally located on the front exterior wall surface 814 of front holding wall member 812, as depicted in FIG. 28 of the drawings. The holding arm member 850 is at a 90° degree angle with respect to the front exterior wall surface 814 of front holding wall member 812. The rod holding sections 852 and 854 are for receiving the end holding sections 35 and 37 fo the standard cylindrical curtain rods 32A and/or 32B respectively, as shown in FIG. 30 of the drawings. Additionally, wall holding clip member 832 is detachably connected to each of the movable front walls 41A and 41B of blind bracket mounting devices 40A and 40B, or to a front wall 53 of the upper beam 54 of blind mounting assembly 52, respectively, as depicted in FIG. 30 of the drawings.

ADVANTAGES OF THE PRESENT INVENTION

Accordingly, an advantage of the present invention is that it provides for an improved blind/curtain mounting bracket for use in attaching one or more curtain rods for hanging curtains and valances in conjunction with a blind bracket mounting device of a standard blind apparatus.

Another advantage of the present invention is that it provides for an improved blind/curtain mounting bracket that is an integrated component of the blind bracket mounting device and prevents the vertical or horizontal blind members from falling out.

Another advantage of the present invention is that it provides for an improved blind/curtain mounting bracket that does not utilize any screws, staples or nails, nor do damage to a standard window blind mounting assembly.

Another advantage of the present invention is that it provides for an improved blind/curtain mounting bracket that does not require any permanent setting on the blind frame assembly, and each curtain mounting bracket is slidably mounted within each blind bracket mounting device.

Another advantage of the present invention is that it provides for an improved blind/curtain mounting bracket that will leave no screw or nail marks, holes or any permanent scarring to the standard window blind mounting assembly.

Another advantage of the present invention is that it provides for an improved blind/curtain mounting bracket that can be installed in less than one minute without the use of any tools.

Another advantage of the present invention is that it provides for an improved blind/curtain mounting bracket that can hold in excess of five (5) pounds of weight.

Another advantage of the present invention is that it provides for an improved blind/curtain mounting bracket that is made of light-weight stamped metals or durable and rigid moldable plastics.

Another advantage of the present invention is that it provides for an improved blind/curtain mounting bracket that can be used with a pair of standard flat curtain rods or with one or more standard cylindrical curtain rod.

A further advantage of the present invention is that provides for an improved blind/curtain mounting bracket that can be mass produced in an automated and economical manner and is readily affordable by the consumer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. Blind/curtain mounting brackets for curtain rods in use with two opposing blind bracket mounting devices of a blind assembly for attaching one or more curtain rods to the blind bracket mounting devices in order to hold a curtain and/or valance thereto, the blind assembly comprising a headrail, and said blind/curtain mounting bracket, comprising:

a) a first bracket housing including a first holding wall member and a second holding wall member being integrally attached with each other at a joint first seam section for forming a first U-shaped clip member detachably overlapping and engaging a movable front wall of one of said blind bracket mounting devices; and wherein said first U-shaped clip member has no oppositely disposed U-shaped clip member so that said first U-shaped clip member provides the only support for said first bracket housing on said movable front wall;

b) said first holding wall member including an exterior first wall surface and an interior first wall surface, and said second holding wall member including an exterior second wall surface and an interior second wall surface;

c) said exterior first wall surface of said first holding wall member including a pair of spaced-apart outer first and inner second holding prong members being integrally connected to said exterior first wall surface;

d) each of said outer first and inner second holding prong members having prong holding first and second side walls with upper first and second prong tab members, respectively, thereon;

e) a second bracket housing including a third holding wall member and a fourth holding wall member being integrally attached with each other at a joint second seam section for forming a second U-shaped clip member detachably overlapping and engaging said movable front wall of one of said blind bracket mounting devices; and wherein said second U-shaped clip member has no oppositely disposed U-shaped clip member so that said second U-shaped clip member provides the only support for said second bracket housing on said movable front wall;

f) said third holding wall member including an exterior third wall surface and an interior third wall surface, and said fourth holding wall member including an exterior fourth wall surface and an interior fourth wall surface;

g) said exterior third wall surface of said third holding wall member including a pair of spaced-apart outer third and inner fourth holding prong members being integrally connected to said exterior third wall surface;

h) each of said outer third and inner fourth holding prong members having prong holding third and fourth side walls with upper third and fourth prong tab members, respectively, thereon;

i) each of said first and second clip members of said first and second bracket housings are detachably connected to said movable front walls of the respective blind bracket mounting devices of the blind assembly; and j) each of said upper first, second, third and fourth prong tab members of said first, second, third, and fourth holding prong members for receiving one or more curtain rods thereon in order to hold a curtain and/or valance thereto.

2. Blind/curtain mounting brackets in accordance with claim 1, wherein said upper second and fourth prong tab members of said inner second and fourth holding prong members are used to receive an inner first flat curtain rod thereon, and said upper first and third prong tab members of said outer first and third holding prong members are used to receive an outer second flat curtain rod thereon.

3. Blind/curtain mounting brackets in accordance with claim 1, wherein said outer first and inner first holding prong members on said first holding wall member are in a parallel relationship with each other.

4. Blind/curtain mounting brackets in accordance with claim 1, wherein said outer second and inner second holding prong members on said second holding wall member are in a parallel relationship with each other.

5. Blind/curtain mounting brackets in accordance with claim 1, wherein said joint first and second seam section is a side seam section.

6. Blind/curtain mounting brackets in accordance with claim 1, wherein said brackets are made from durable, rigid moldable plastics or from light-weight stamped metals.

7. Blind/curtain mounting brackets in accordance with claim 1, wherein said brackets can hold in excess of five (5) pounds of weight when in an assembled state and in operational use thereof.

* * * * *